US006117830A

United States Patent [19]

Yokosuka et al.

[11] Patent Number: 6,117,830

[45] Date of Patent: Sep. 12, 2000

[54] LIQUID DETERGENT COMPOSITION FOR HARD SURFACE AND METHOD FOR CLEANING HARD SURFACE

[75] Inventors: Michio Yokosuka; Masashi Yoshikawa; Junichiro Nishiwaki; Masaki Tosaka; Yoshiyuki Watanabe, all of Wakayama, Japan

[73] Assignee: Kao Corporation, Tokyo, Japan

[21] Appl. No.: 08/973,873

[22] PCT Filed: Apr. 18, 1997

[86] PCT No.: PCT/JP97/01356

§ 371 Date: Jan. 7, 1998

§ 102(e) Date: Jan. 7, 1998

[87] PCT Pub. No.: WO97/42296

PCT Pub. Date: Nov. 13, 1997

[30] Foreign Application Priority Data

May 7, 1996 [JP] Japan ..... 8-112787
Jan. 28, 1997 [JP] Japan ..... 9-013860

[51] Int. Cl.[7] ..... C11D 7/22

[52] U.S. Cl. ..... 510/242; 510/418; 510/438; 510/466

[58] Field of Search ..... 510/241, 242, 510/418, 438, 466

[56] References Cited

U.S. PATENT DOCUMENTS

| | | | |
|---|---|---|---|
| 3,965,756 | 6/1976 | Smith | 510/241 |
| 4,005,028 | 1/1977 | Heckert et al. | 510/242 |
| 4,005,030 | 1/1977 | Heckert et al. | 510/242 |
| 4,481,126 | 11/1984 | Trinh et al. | 510/242 |
| 4,512,677 | 4/1985 | Trinh | 510/242 |
| 4,977,912 | 12/1990 | Oota et al. | 510/241 |
| 5,431,848 | 7/1995 | Getty | 510/303 |

FOREIGN PATENT DOCUMENTS

| | | |
|---|---|---|
| 54-75808 | 6/1979 | Japan . |
| 55-7840 | 1/1980 | Japan . |
| 58-154774 | 9/1983 | Japan . |
| 61-159474 | 7/1986 | Japan . |
| 61-192799 | 8/1986 | Japan . |
| 62-72800 | 4/1987 | Japan . |
| 64-40600 | 2/1989 | Japan . |
| 2-58589 | 2/1990 | Japan . |
| 2-117979 | 5/1990 | Japan . |
| 3-97799 | 4/1991 | Japan . |
| 3-232000 | 10/1991 | Japan . |
| 4-136100 | 5/1992 | Japan . |
| WO 93/20173 | 10/1993 | WIPO . |

OTHER PUBLICATIONS

English language translation of JP 61–159,474, Toshiba Silicone Co., Jul. 1986.

English language translation of JP 63–271,642, Johnson Corp., May 1990.

English language translation of JP 61–192,799, Ishihara Drug Co., Aug. 1986.

English language Derwent Abstract of JP 61–192,799, Ishihara Yakuhin, Aug. 1986.

*Primary Examiner*—Caroline D. Liott

*Attorney, Agent, or Firm*—Oblon, Spivak, McClelland, Maier & Neustadt, P.C.

[57] ABSTRACT

A liquid detergent composition for cleaning hard surfaces comprising, a liquid washing medium, and globular particles having a mean particle diameter of 0.01 to 15 μm which are insoluable in the liquid washing medium, with the provisos that the content of the globular particles in the composition is 0.1 to 30% by wt. and that the viscosity of the composition is 2 to 500 cps determined at 20° C.

13 Claims, No Drawings

LIQUID DETERGENT COMPOSITION FOR HARD SURFACE AND METHOD FOR CLEANING HARD SURFACE

TECHNICAL FIELD OF THE INVENTION

The present invention relates to a liquid detergent composition for hard surfaces for cleaning surfaces made of hard materials, such as car bodies, and a method for cleaning hard surfaces. More specifically, the present invention relates to a liquid detergent composition with which one can wash a hard surface having a particulate solid dirt thereon, without causing marring of the surface by the particulate solid dirt, and make the surface clean and can wash it, without pre-washing by water and the like, directly in a small amount of a liquid, and relates to a method for cleaning the hard surfaces.

PRIOR ART

In washing a hard surface, for example car body, having thereon particulate solid dirt resulting from house dust, soil, earth sand and the like according to the prior art, it was necessary in order to protect the surface from being marred by the dirt that while the dirt is removed from the surface with an excess of water or a detergent solution or after it had preliminarily been removed therefrom, the other stains were removed. Further, there occurred a problem that the hard surface was marred also by the material used in wiping the surface, e.g., cloth, paper, non-woven fabric, sponge or the like. However, there are lots of cases that the places where a hard surface to be generally an object of washing is present does not permit the use of a large amount of water, or the use of a large amount of water remarkably lowers the workability, even if it was possible. This is true of all of the commercially available current detergents for the purpose of use to the hard surface.

It is generally known that lubricants are used for preventing marring to the hard surface due to friction between solid particles and the hard surfaces, in which, in general, the surfaces of solid particles and the hard surface are adsorbed by the lubricants to form local pressure lubricant membrane, thus marring is prevented. Therefore, such a lubricants that have high adsorptive activity to both solid particles and hard surfaces and are not destroyed in the resulting adsorbing membrane thereof under local pressures are required. To the lubricants mentioned above it is essential matters that molecular structures of the lubricants are never deformed under local pressures and friction among moleculars is small.

However, when such a lubricant, having higher adsorptive activity and higher preventing ability for marring, is applied to a surface to be washed, the lubricant as such would remain thereon as soil. For example, grease which is believed to be advantageous in anti-marring properties has problems that the anti-marring properties are poor when the grease is wiped off the surface by a hand method and that the grease per se remains as a stain, therefore, eliminating the dirt can not be achieved. Moreover, the higher the anti-marring property of the lubricant is by making the lubricant membrane hard to be destroyed under a localized pressure, the bigger the shearing resistance of the lubricant becomes during wiping process with cloth, so that the workability is reduced as much as the level that it is actually impossible to working, even wiping off such an area of as small as 0.1 $m^2$.

JP-A-58-154774 discloses a lustering agent comprising organic fine powder in which each particle is in spherical or approximately spherical shape having a diameter of not more than 100 micron.

JP-A-61-159474 discloses a lustering agent comprising (A) wax and (B) polymethylsilsesquioxane.

JP-A-2-117979 discloses a lustering agent comprising wax and/or wax type substance and silicone powder.

Those technologies are a lusturing composition mainly of wax, but are not intended to deterge the surface soiled with solid particles.

SUMMARY OF THE INVENTION

Under these circumstances, the object of the present invention is to provide a detergent composition for hard surfaces which can deterge a hard surface having a particulate solid dirt thereon without marring the surface even when no pre-washing is conducted and a large amount of water or a detergent is not used, whereby the washing process can be made very easy and simple, the necessary labor can be much decreased and the cleaning of the hard surface can be accomplished without impairing the beautiful appearance of the surface, and a method for cleaning hard surfaces with the detergent composition.

The present inventors have made intensive studies from the standpoint of washing, without pre-washing, a hard surface having a particulate solid dirt thereon by wiping with a small amount of a liquid with the surface, protected from being marred by the dirt to find that a composition containing specific globular particles and having a viscosity controlled within a specific range exhibits excellent anti-marring properties in washing by wiping, and that the composition is excellent in workability and detergency and is extremely effective in keeping the beautiful appearance of the surface. The present invention has been accomplished on the basis of these findings.

That is, the present invention provides a liquid detergent composition for hard surfaces which is for deterging a hard surface having a particulate solid dirt thereon by applying thereto and wiping the dirt and cleaning the hard surface, wherein the composition comprises:

(a) a liquid deterging medium, and (b) globular particles having a mean particle diameter of 0.01 to 15 $\mu$m and being insoluble in the liquid deterging medium, the content of the component (b) in the composition being 0.1 to 30% by weight, the viscosity of the composition being 2 to 500 cps as determined at 20° C. in a uniformly stirred state.

Further, the present invention also provides another liquid detergent composition for hard surfaces comprising the above component (a) and (b) and a liquid lubricating component as component (c) wherein the ratio of the component (c) to the component (b) is 0.01 to 10.

Further, the present invention also provides a liquid detergent composition for hard surfaces comprising the above components (a), (b) and (c) and a surfactant or a polymeric dispersant as component (d).

The present invention also provides a method for cleaning a hard surface which comprises steps of applying, to a hard surface having a particulate solid dirt, the above detergent composition and wiping the composition together with the dirt to make the surface clean, particularly a method for deterging a hard surface, which comprises steps of applying, to a car body having a particulate solid dirt, a liquid detergent composition that comprises:

(a) a liquid deterging medium, (b) globular particles having a mean particle diameter of 0.01 to 15 $\mu$m and being insoluble in the liquid deterging medium, and (c) a polyorganosiloxane oil being liquid at 20° C., the content of the component (b) in the composition being 0.1 to 30% by weight, the weight ratio of the component (c) to the component (b) being 0.01 to 10, the viscosity of the composition being 2 to 500 cps as determined at 20° C. in a uniformly stirred state, without pre-washing, and wiping the composition together with the dirt to make the car body clean.

In the present invention, the spherical particles having a high mobility move cyclically under pressure by hand while accompanying solid dirt particles therewith. As a result, it brings about an effect of lowering the rate of contact with the hard surface to be washed to the ultimate limit (i.e., circulation-dilution effect) and another effect of dispersing the stress applied by hand through free motion of many particles in the washing liquid to lower the contact pressure of the abrasive grains (i.e., contact pressure lowering effect). Thus, the composition of the present invention exhibits anti-marring properties according to the two effects described above.

In the present invention, it is important to attain satisfactory anti-marring properties that the particles conduct enough free motion during the washing. Therefore, it is the most important to satisfy the requirements that the liquid detergent composition of the present invention exhibits a low viscosity of as 2 to 500 cps at 20° C.; that the particles contained in the composition of the present invention have such a shape having little interaction causing little aggregate in a fluid, that is, a spherical shape; and that the average particle diameter of the particles is approximately the same size as those of solid particle dirt (0.01 to 15 $\mu$m). Further, it is more effective that the particles have a low surface energy.

In order to realize more excellent anti-marring properties, it is effective that the spherical particles have a proper true specific gravity of 0.5 to 2.5, by which the rate of contact of the particles with a hard surface and the cyclic movement properties of the particles in a washing fluid are maintained constant at a suitable level. Further, it is also effective in keeping the free movement of the particles even under pressure due to wiping, without the deformation of the particles, that the elastic modulus of the particles is 10 $kg/mm^2$ or above. Furthermore, the elastic modulus is desirably 1,000 $kg/mm^2$ or below to protect the surface from being marred by the particles.

Further, the globular particles contained in the detergent composition of the present invention is further enhanced in the free movement causing the anti-marring effect according to the present invention to attain a further enhanced anti-marring effect, when the composition further contains a liquid lubricating component of globular particles which is little adsorbed to a particulate solid dirt and the surface to be washed, preferably a polyorganosiloxane oil.

Further, the globular particles according to the present invention enlarge a quasi specific surface area of the material used in wiping the dirt and the above enhanced free movement can effectively remove just the dirt without marring the surface to be washed.

When water is used as the liquid deterging medium, the anti-marring properties and detergency can be enhanced. The reason is that the particulate solid dirt remaining on a hard surface generally results from house dust, soil, earth or sand, the particle-soiled surface is, hydrophilic and the system includes a certain amount or above of water, so that the dirt particles may be effectively dispersed in a washing fluid.

The free motion of the globular particles used in the present invention is hindered by a high-viscosity oily component particularly resulting from oily dirt, for example, oxidation-polymerized fats or oils or a high-viscosity oily substance resulting from exhaust gas. Therefore, it is preferable that the free motion of the globular particles be secured by using a mixture of water with an organic solvent as the liquid washing medium to thereby enhance the ability to wash a hard surface without marring the surface. The simultaneous use of this organic solvent with the above liquid lubricating component (such as polyorganosiloxane oil) is advantageous to the anti-marring properties, because the organic solvent lowers the viscosity of the liquid lubricating component to further enhance the motion properties of the globular particles. Further, the addition of a surfactant or a polymeric dispersant is advantageous to both anti-marring properties and detergency, because it not only prevents the aggregation of the particles to secure the free motion thereof, but also accelerates the dispersion of particulate solid dirt.

MODE FOR CARRYING OUT THE INVENTION

The embodiments of the present invention will now be described.

The detergent composition of the present invention contains a liquid deterging medium as component (a). The term "liquid deterging medium" used in this specification refers to a liquid medium which has a boiling point of lower than 300° C. and serves to facilitate the release of particulate solid dirt. Specific examples thereof include water, organic solvents having boiling points of 70 to 300° C. and silicone oils having boiling points of lower than 300° C. (comprising at least one of cyclic silicones, volatile dimethylsiloxanes or the like). Among these media, water or a mixture of water with an organic solvent is preferable, the mixture being still preferable. The preferred mixing ratio of water: organic solvent is 5 to 20:1. The mixture can be any forms such as emulsion system, solubilization system and separation system.

The organic solvents to be used in the present invention include hydrocarbon solvents having 8 to 20 carbon atoms and ether solvents represented by the formula (III):

$$CH_3(CH_2)_pO(CH_2CH_2O)_q(C_3H_6O)_r(CH_2)_sR_4 \quad \text{(III)}$$

(wherein $R_4$ is H, $CH_3$ or OH; and p, q, r and s are each independently a integer of 0 to 20).

Specific examples of the organic solvents include hydrocarbon solvents such as decane, undecane, dodecane, tridecane, tetradecane and isoparaffin; and ether solvents such as diethylene glycol monoethyl ether, diethylene glycol monobuytl ether, diethylene glycol dimethyl ether, diethylene glycol diethyl ether, propylene glycol monomethyl ether, propylene glycol monoethyl ether, dipropylene glycol monomethyl ether, dipropylene glycol monoethyl ether and dipropylene glycol dimethyl ether, among them the hydrocarbon solvents are particularly preferable.

The detergent composition of the present invention contains, as component (b), globular particles having a mean particle diameter of 0.01 to 15 $\mu$m and being insoluble in the above liquid deterging medium. The term "globular (spherical) particles" used in this specification include not only truly spherical ones but also elliptical ones. However, at least 90% by number of the globular particles are preferable because a higher sphericity defined in below of the particles is more advantageous to the motion properties and anti-aggregation properties of the particles.

Sphericity

Each sphericity was determined by taking an electron micrograph of solid particles, selecting at random 100 projected images not overlapping each another, further selecting spherical projected images and projected images whose outlines were each completely included within the zone between its circumscribed circle and a circle being concentric with the circumscribed circle and having a radius of 90% of that of the circumscribed circle from among the 100 projected images and taking the total number of them as the sphericity.

The mean particle diameter of the globular particles to be used in the present invention is 0.01 to 15 $\mu$m, preferably 0.1 to 10 $\mu$m, still preferably 1 to 5 $\mu$m. When the mean particle diameter is in the range of 0.01 to 15 $\mu$m, the number of particles per unit weight is suitable for attaining an excellent efficiency, and such particles are equivalent to particulate solid dirt generally present in a hard surface in sizes and therefore can attain an excellent washing efficiency against the dirt.

The term "mean particle diameter" used in this specification with respect to the globular particles refers to one determined by the following method.

Method for Measuring Mean Particle Diameter

Particles are completely dispersed in any dispersion medium selected from among water, methanol and a 1% aqueous solution of $C_{12}H_{25}O(CH_2CH_2O)_6H$ by ultrasonic wave, and examined for diameter by a light scattering type particle size distribution measure (LA-500, mfd. by HORIBA etc.).

The weight ratio of particles/dispersion medium was determined by adding the particles to the dispersing medium until the concentration indication value of the particle size distribution measure is reached to the indication of "optimum".

The volume-mean diameter of the particles is calculated from the diameters thus determined and the obtained value is taken as the mean particle diameter of the particles in the present invention. In the case wherein the maximum particle diameter thus determined is (a+a/2) or above or the minimum one is (a−a/2) or below (wherein a is the mean particle diameter), the volume-mean particle diameter of particles having diameters ranging from (a−δ) to (a+δ) (wherein δ is the standard deviation) is again calculated and the obtained value is taken as the mean particle diameter thereof in the present invention.

In order to keep the rate of contact of the globular particles with a hard surface and the cyclic mobility of the particles in washing fluid during washing at respective suitable levels, it is preferable that the true specific gravity of the globular particles is 0.5 to 2.5, still preferably 0.5 to 1.5. Further, it is also preferable in order to enhance the mobility of the particles on a hard surface that the cohesion of the particles is low. In order to attain such a preferred embodiment, it is preferable that the surface energy of the material of the particles is 60 dyne/cm or below.

The term "surface energy" used in this specification refers to a value determined by the following method.

Method for Measuring the Surface Energy of Solid

A surface tension (γ) is assumed to be the sum of a term ($\gamma^d$) due to London dispersion force and a term ($\gamma^p$) due to polar force.

$$\gamma=\gamma^d+\gamma^p \quad (1)$$

Meanwhile, the $\gamma^d$ and $\gamma^p$ values of a solid surface can be determined by measuring the contact angle with each two liquids (distilled water and methylene iodide) having known $\gamma^d$ and $\gamma^p$ values.

$$(b_1+C_1+a_1)\gamma^d\gamma^p+c_1(b_1-a_1)\gamma^d+b_1(c_1+a_1)\gamma^p-a_1b_1c_1=0 \quad (2)$$

$$(b_2+C_2+a_2)\gamma^d\gamma^p+c_2(b_2-a_2)\gamma^d+b_2(c_2-a_2)\gamma^p-a_2b_2c_2=0 \quad (3)$$

$$a_1=(1/4)\gamma_1(1+\cos\theta_1) \quad a_1=(1/4)\gamma_1(1+\cos\theta_1)$$

$$b_1=\gamma_1^d \quad b_2=\gamma_2^d$$

$$c_1=\gamma_1^p \quad c_2=\gamma_2^p$$

$\theta_1$: contact angle of distilled water on solid surface $\theta_2$: contact angle of methylene iodide on solid surface Surface tension of distilled water $$\gamma_1=72.8 \text{ dyne/cm}$$

$$\gamma_1^d=22.1 \text{ dyne/cm}$$

$$\gamma_1^p=50.7 \text{ dyne/cm}$$

Surface tension of methylene iodide $$\gamma_2=50.8 \text{ dyne/cm}$$

$$\gamma_2^d=44.1 \text{ dyne/cm}$$

$$\gamma_2^p=6.7 \text{ dyne/cm}$$

The dispersion force component ($\gamma^d$) and polar force component ($\gamma^p$) of the surface tension of the solid surface are calculated according to the above formulae (2) and (3), and the surface tension, i.e., surface energy, of the solid is calculated by substitution of the obtained values in the formula (1).

Further, it is preferable that the elastic modulus of the globular particles used in the present invention is 10 to 1,000 kg/mm$^2$, more desirably 50 to 500 kg/mm$^2$, most desirably 100 to 300 kg/mm$^2$ to keep their free movement without being deformed even under a pressure due to wiping to attain a satisfactory anti-marring effect and to inhibit the particles per se from marring the surface to be washed. the particles.

The term "elastic modulus" used in this specification refers to one determined by the following method.

Method for Measuring Elastic Modulus

One of the particles is examined for compressive displacement by the use of a microcompression tester for powder, PCT-200 (mfd. by Shimadzu Corporation), and the E value is calculated from the load giving 10% deformation in the diameter according to the following formula. The E value thus calculated is taken as the elastic modulus of the particles.

The examination is conducted at 20 to 25° C. by using a particle having a diameter of 3 to 10 $\mu$m. In the case wherein none of the particles has a diameter falling within this range, a particle being made of the same material as that of the particles and having a diameter of 3 to 10 $\mu$m is examined and the obtained E value is taken as the elastic modulus of the particles.

F: compressive force (kg)

S: compressive deformation (mm)

E: elastic modulus of the particles in compression (elastic modulus, kg/mm$^2$)

R: radius of the particle (mm)

$$E = \frac{3 \times F \times (1 - (0.38)^2)}{\sqrt{2} \times S^{1.5} \times \sqrt{R}}$$

In order to satisfy the above requirements, it is preferable that the globular particles to be used in the present invention be made of one or two or more members selected from the group consisting of those described in the following items ① to ⑧, preferably from the group consisting of those described in the items ②, ④, ⑥, ⑦ and ⑧, particularly preferably from the group consisting of those described in the items ② and ④.

① polymers prepared by polymerizing at least one ethylenically unsaturated monomer selected from the group consisting of alkyl acrylates and methacrylates (wherein the number of carbon atoms of alkyl is 1 to 8); mono- and di-alkyl esters of itaconic acid and fumaric acid (wherein the number of carbon atoms of alkyl is 1 to 5), maleic anhydride, vinylidene chloride, styrene, divinylbenzene, vinyl chloride, vinyl acetate, vinyl acetal, ethylene, propylene, butene, isobutylene, methylpentene, butadiene, vinyltoluene, acrylonitrile, methacrylonitrile, acrylamide, acrylic acid, methacrylic acid, itaconic acid, fumaric acid, citraconic acid, crotonic acid, β-acryloyloxypropionic acid and hydroxyalkyl esters of acrylic acid and methacrylic acid (wherein the number of carbon atoms of alkyl is 1 to 6);

② silicone resins composed of units represented by the formulae (I) and (I') [for example, Trefil R-925, R-930 and R-935 (products of Dow Corning Toray Co., Ltd.)]

(I)

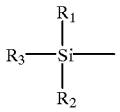

(I')

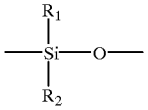

(wherein $R_1$, $R_2$ and $R_3$ are each independently a $C_1$–$C_{100}$ alkyl group, an alkoxy group, a hydroxyalkyl group, hydroxyl group, a siloxy group, a carboxyl group, a carboxyalkyl group, an N-(2-aminoalkyl)aminoalkyl group, an aminoalkyl group, an amino group, an epoxyalkyl group, an epoxy group, a methylpolyoxyethylenealkyl group, a hydroxypolyoxyethylenealkyl group, a methylpolyoxyethylene-polyoxypropylene group, a hydroxypolyoxyethylene-polyoxypropylene group, an alkylpolyoxyethylene group, a polyoxyethylene group, a phenyl group or a fluoroalkyl group);

③ at lease one resins selected from nylon, polyester, epoxy, amino-alkyd, urethane, polyacetal and polycarbonate;

④ polyorganosilsesquioxanes prepared by hydrolyzing and condensing methyltrialkoxysilanes or products of partial condensation thereof through hydrolysis in an aqueous solution of ammonia or an amine [for example, Tospearl 103, 105, 108, 120, 130, 145 and 2000B (products of Toshiba Silicone Co., Ltd.), KMP-590 and KMP-590C (a product of Shin-Etsu Chemical Co., Ltd.);

⑤ silica or porous silica;

⑥ polymers prepared by copolymerizing ethylenically unsaturated monomers as described in the above item ① with silicone derivative monomers represented by the above formulae (I) and (I');

⑦ polymers prepared by modifying resins described in the item ③, polyorganosilsesquioxanes described in the item ④ or silica or porous silica described in the item ⑤ with ethylenically unsaturated monomers described in the item ① and/or silicone derivative monomers represented by the formulae (I) and (I') [for example, polymers prepared by the addition of acrylic acid, methacrylic acid, trimethylhydroxysiloxane or the like to the silanol groups present on the surface of polyorganosesquioxanes/silica/porous silica]; and ⑧ polymers prepared by incorporating ethylenically unsaturated monomers described in the term ① or silicone derivative monomers represented by the formulae (I) and (I') into the main chains of resins described in the item ③ [for example, polymers prepared by forming reactive sites on the main chains by partial oxidation, addition with an epoxy group or the like and conducting the addition reaction of the resulting resin with acrylic acid, methacrylic acid and/or trimethylhydroxysiloxane].

The detergent composition of the present invention contains the globular particles described above in an amount of 0.1 to 30% by weight. When the content of the globular particles is less than 0.1% by weight, the resulting detergent composition will not contain enough particles for particulate solid dirt generally present on an object washing surface and therefore will be remarkably poor in the objective anti-marring properties according to the present invention. On the contrary, when the content exceeds 30% by weight, the resulting detergent composition will contain excessive particles in comparison with the liquid components of the composition, so that the movement of the particles will be hindered to result in poor anti-marring properties and that the removal of the particles from the surface after washing will be difficult to result unfavorably in poor workability.

In order to enhance the free movement properties of the globular particles to attain more excellent anti-marring properties, it is necessary that the viscosity of the detergent composition is in the range from 2 to 500 cps, preferably 3 to 100 cps, still preferably 3 to 50 cps as determined at 20° C. in a uniformly stirred state.

The term "viscosity" used in this specification refers to one determined by the following method.

Method for Measuring Viscosity 100 ml of a sample is put in a beaker for the determination of viscosity (inside diameter: Ø 3.6 cm, height: 13 cm) and the resulting beaker is immersed in a thermostatic water bath at 20° C. for at least 30 minutes. After it has been confirmed that the temperature of the liquid sample has reached 20° C., the beaker is covered with a wrap or the like and vigorously shaken vertically at least 30 times to make the contents uniform. Within 10 seconds after the completion of the shaking, a Brookfield type viscometer (mfd. by Tokimec, Inc.) No. 1 rotor is rotated at 60 rpm and the value indicated by a pointer after one minute is taken as the viscosity (cps) of the sample.

When the viscosity of the detergent composition at 20° C. is less than 2 cps, the mobility of the globular particles will be so high that the removal of the particles per se by wiping will be difficult to result in poor detergency and that the particles will move without dispersing the stress applied by hand to result in poor anti-marring effect. On the contrary, when the viscosity exceeds 500 cps, not only the movement of the globular particles will be hindered to result in poor dilution effect and local pressure dispersing effect, but also the sliding properties of the material used in wiping will be so poor that a remarkably increased force will be required for the work and that the force for keeping the material will be increased to result in an increased stress perpendicular to the hard surface to be washed, which will lead to enhanced marring action. Further, when the viscosity is higher than 500 cps, the removability of the composition by wiping will be poor to result in lowered workability and poor detergency.

When the detergent composition of the present invention is used in a state charged into a container for spraying, it is desirable in order to enable the ejection of the composition through a narrow nozzle with wide spreading thereof either by manpower or with a conventional domestic pressurized gas (10 kg/cm$^2$ or below) that the viscosity of the composition is 200 cps or below, more desirably 100 cps or below, most desirably 50 cps or below. When the viscosity exceeds 200 cps, the ejection of the composition will be actually impossible for the above reasons.

If necessary, the detergent composition of the present composition may further contain a liquid lubricating component as component (c) to further enhance the effects of a washing liquid to be used in the washing. The term "liquid lubricating component" used in this specification refers to a liquid component having a boiling point of 300° C. or above and a viscosity of as low as 500 cps or below, specifically, a silicone oil being liquid at 20° C. and having a boiling point of 300° C. or above, for example, polyorganosiloxane oil. The component (c) does not include so-called waxes, and specific examples of the waxes include vegetable waxes such as carnauba wax and cotton wax; animal waxes such as beeswax and lanolin; mineral waxes such as montan wax and ceresin wax; and petroleum (synthetic) waxes such as solid paraffin, microcrystalline wax, polyethylene wax and productions of oxidation of them.

The use of such a wax have a disadvantage in that the resulting detergent composition becomes easy of taking dirt thereinto to result in lowered performance as detergent.

The polyorganosiloxane oil being liquid at 20° C. to be used in the present invention as component (c) includes those composed of units represented by the above formulae (I) and (I'). In particular, it is preferable to use a polyorganosiloxane oil as represented thereby wherein the organic groups are at least one group selected from the group consisting of, having $C_1$–$C_{80}$, an alkyl group, an aminoalkyl group, an N-(2-aminoalkyl)aminoalkyl group, a methylpolyoxyethylenealkyl group, an alkoxy group, an epoxyalkyl group, a carboxyalkyl group and a phenyl group. In order to enhance the mobility of the globular particles, it is still preferable that the viscosity of the polyorganosiloxane oil at 25° C. be 2 to 5,000 cps.

Specific examples of the polyorganosiloxane oil to be used in the present invention include dialkylsiloxanes, alkylphenylsilicones, alkyl-modified silicones, alkoxy-modified silicones, hydroxy-modified silicones, carboxy-modified silicones, epoxy-modified silicones and amino-modified silicones. Compounds represented by the formula (II) are particularly preferable:

(II)

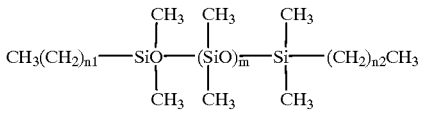

(wherein $n_1$ and $n_2$ are each 1 to 100; and m is an integer of 1 to 5000).

These polyorganosiloxane oils are commercially available under the trade names of KF56, KF-412, KF-413, KF-414, KF50, KF53, KF54, KF56, KF994, KF995, KF9937, X22-161AS, X22-161A, X22-161B, KF8012, KF393, KF859, KF860, KF861, KF867, KF869, KF880, KF8002, KF8004, KF8005, KF858, KF864, KF865, KF868, KF8003, KF-105, X22-163A, X22-163B, X22-163C, KF-1001, KF101, X22-169AS, X22-169B, KF-102, X22-162A, X22-162C, X22-3701E, X22-3710, X22-160AS, KF6001, KF6002, KF6003, X22-4015, KF-857, KF862, KF8001, X22-3667 and X22-3939A (products of Shin-Etsu Chemical Co., Ltd.); and TSF-451, TSF4700 and TSF4701 (products of Toshiba Silicone Co., Ltd.), which are usable in the present invention.

It is preferable that the content of the component (c) in the detergent composition of the present invention lie preferably within such a range that the weight ratio of the component (c) to the component (b), ((c)/(b)), ranges from 0.01 to 10, still preferably 0.1 to 5. The detergent composition of the present invention is particularly preferably one which comprises a mixture comprising 1 to 10% by weight of an organic solvent having a boiling point of 70 to 300° C. and 50 to 97% by weight of water as the component (a), 1 to 10% of the globular particles as the component (b) and 1 to 10% by weight of a polyorganosiloxane oil as the component (C).

It is preferable that the detergent composition of the present invention further contains a surfactant or a polymeric dispersant as component (d). In other words, it is preferable that in preparing the detergent composition of the present invention by emulsifying and/or dispersing the globular particles alone or together with a liquid lubricating component (such as polyorganosiloxane oil) and/or an organic solvent in water, the emulsification and/or dispersion and the re-dispersion of the particles be made easier by adding at least one member selected from the group consisting of among surfactants and polymeric dispersants.

The content of the surfactant in the deterging composition or the present invention is preferably 0.001 to 5% by weight, still preferably 0.01 to 2% by weight, while that of the polymeric dispersant therein is preferably 0.001 to 3% by weight, still preferably 0.01 to 1% by weight.

The surfactant to be used in the present invention is preferably an anionic or nonionic one, specifically one or more members selected from the group consisting of alkylbenzenesulfonates, alkylsulfonates, polyoxyethylene alkyl ether sulfonates, alkylpolyglycosides, fatty acid salts, alkylsucrose esters, alkyl esters of sorbitan and polyoxyethylene alkyl esters, still preferably one having an average alkyl chain length of 8 to 18 carbon atoms.

The polymeric dispersant to be used in the present invention includes polymers prepared by polymerizing at least one ethylenically unsaturated monomer selected from the group consisting of alkyl esters of acrylic acid and methacrylic acid (wherein the number of carbon atoms of alkyl is 1 to 8), mono- and di-alkyl esters of itaconic acid and fumaric acid (wherein the number of carbon atoms of alkyl is 1 to 5), maleic anhydride, vinylidene chloride, styrene, divinylbenzene, vinyl chloride, vinyl acetate, vinyl acetal, ethylene, propylene, butene, isobutylene, methylpentene, butadiene, vinyltoluene, acrylonitrile, methacrylonitrile, acrylamide, acrylic acid, methacrylic acid, itaconic acid, fumaric acid, citraconic acid, crotonic acid, β-acryloyloxypropionic acid, hydroxyalkyl esters of acrylic acid and methacrylic acid (wherein the number of carbon atoms of alkyl is 1 to 6), and vinylpyrrolidone and derivatives thereof. The molecular weight of the polymeric dispersant is desirably 100 to 100,000, more desirably 1,000 to 50,000, most desirably 3,000 to 10,000.

In addition, as the polymeric dispersant of the present invention, following viscosity increasing polysaccharides (1) to (3) can be used.

(1) guar gum, locust bean bum, quince seed gum, Tara gum, carrageenan, alginic acid (or salts thereof), forcellan, agar, arabino galactan gum, gum arabic, gum tragacanth, karaya gum, pectin, starch, xanthan gum, xan coat, xan flow, cardrun, Succinoglucane schizofillan, Pullulan, Jeran gum, Wellan gum, Rnthan gum, galacto mannan, hyaluronic acid (or salts thereof), chondroitin sulfate (or salts thereof), chitin, chitosan;

(2) oxides, methylates, carboxymethylates, hydroxyethylates, hydroxypropylates, sulfate, phosphates and cationic derivatives of the above mentioned polysaccharides; and (3) water-soluble cellulose derivatives such as carboxymethyl cellulose, methyl cellulose, hydroxyethyl cellulose hydroxypropyl cellulose, hydroxyethylpropyl cellulose.

The molecular weight of the above polysaccharides described in items (1) to (3) is preferably in the range from 100,000 to 10,000,000.

Specific examples of these polysaccharides are shown in the following Table.

| No. | Name of substance | Trade Name | Maker |
|---|---|---|---|
| 1 | xanthan gum | kelzan T | KELCO |
| 2 | Jeran gum | kelcogel | KELCO |
| 3 | wellan gum | KIA96 | KELCO |
| 4 | Ranthan Gum | KIA112 | KELCO |
| 5 | Guar Gum | Genugum CH-200 | Copenhagen Factory |
| 6 | Hydroxypropyl Guar Gum | JAGUAR 8111 | Meyhall |
| 7 | Carboxymethylhydroxypropyl Guar Gum | JAGUAR 8600 | Meyhall |
| 8 | Cationic Guar Gum | JAGUAR C-13s | Meyhall0 |
| 9 | Sodium Alginate | Kelgin HV | KELCO |
| 10 | Pectin | Genupectin JM | Copenhagen Factory |
| 11 | carrageenan | GENUGEL WR-78 | Copenhagen Factory |
| 12 | Locust Bean Gum | Meypro LBG Lak | Meyhall |
| 13 | Tara Gum | Spino Gum | Fuso Yakuhin |
| 14 | Pullulan | Pullulan PI-20 | Hayashibara Syouji |
| 15 | Sodium Hyaluronate | Biohyaluronate | Asahi Chemical Industry Co., Ltd. |
| 16 | Hydroxyethylcellulose | HEC Daicel SP500 | Daicel Chemical Industries, Ltd. |
| 17 | Sodium carboxymethylcellulose | CMC Daicel 1220 | Daicel Chemicai Industries, Ltd. |

The method for cleaning a hard surface according to the present invention is one which comprises applying to a hard surface having a particulate solid dirt thereon with the above detergent composition and wiping both composition and dirt off the surface to make the surface clean. A preferred embodiment of the method is a method for cleaning a car body which comprises applying a car body having particulate solid dirt thereon with a liquid detergent composition that comprises (a) a liquid washing medium, (b) globular particles having a mean particle diameter of 0.01 to 15 $\mu$m and being insoluble in the liquid washing medium, and (c) a polyorganosiloxane oil being liquid at ordinary temperatures, with the provisos that the content of the component (b) in the composition is 0.1 to 30% by weight, that the weight ratio of the component (c) to the component (b) is 0.01 to 10 and that the viscosity of the composition is 2 to 500 cps as determined at 20° C. in a uniformly stirred state, without pre-washing, and wiping both composition and dirt off the car body to make the car body clean.

In the present invention, methods for applying the detergent composition to the hard surface is not particularly limited. For example, applying with a clean-wiping material and spraying by a spray or the like.

It has been found that in washing a hard surface with the detergent composition of the present invention, the above globular particles must be made present on the surface in such an amount as to cover the hard surface at a definite area or more or to give in a definite particle/dirt quantity ratio or more. It is effective that the washing is conducted in such a state that the globular particles are present on the surface in a weight amount of 0.05 to 5 g/m$^2$, more effectively 0.2 to 2 g/m$^2$ or that the total projected area of the globular particles accounts for 30 to 300% of the surface area of the hard surface, more effectively 50 to 200% thereof.

In the present invention, each total projected area is calculated by the following method.

Method for Calculating Total Projected Area

When the content of solid particles in the composition is abbreviated to "a %", the surface area of the hard surface to be washed "b cm$^2$", the amount of the composition used in washing "c g" and the average projected area per g of the particles* "d cm$^2$/g", total projected area of the particles $$= d \times c \times \frac{a}{100}\ \text{cm}^2$$

(ratio of the total projected area of the particles to the surface area of the hard surface to be washed)

$$= \frac{d \times c \times \frac{a}{100}}{b} \times 100 = \frac{a \times d \times c}{b}\ \%$$

* The average projected area per g of the particles, i.e., d cm$^2$/g is calculated by the following formula.

When the mean particle diameter of the particles is abbreviated to "e cm" and the density of the particles "f g/cm$^3$", volume per g of the particles=f×1 g=f $cm^3$
volume per particle $$= \frac{4}{3}\pi\left(\frac{e}{2}\right)^3$$

$$= \frac{1}{6}\pi e^3 \text{ cm}^2$$

$$\therefore \text{ number of particles per g} = \frac{f}{\frac{1}{6}\pi e^3} = \frac{6f}{\pi e^3} \text{ lot/g}$$

projected area per particle $$= \pi\left(\frac{e}{2}\right)^3$$

$$= \frac{1}{4}\pi e^2 \text{ cm}^2$$

$$\therefore \ d \text{ cm}^2/\text{g} = \frac{1}{4}\pi e^2 \times \frac{6f}{\pi e^3}$$

$$= \frac{3f}{2e} \text{ cm}^2/\text{g}$$

The pH of the detergent composition of the present invention is preferably 3 to 12, still preferably 5 to 10, though the pH thereof is not particularly limited.

The detergent composition of the present invention is suitably applied by a trigger type sprayer, though the method of using it is not particularly limited. Further, it is particularly preferable in workability that the detergent composition take the form of mist or liquid when sprayed on the surface to be washed, though it is not particularly limited in this respect but may take various forms such as foam, mist, liquid and so on.

Although the hard surface to be cleaned by the method of the present invention is not particularly limited, examples thereof include glass; stainless steel; synthetic marble; plastics such as acrylics and ABS; and resin-coated and metal-plated surfaces of metals, wood and plastics. Specifically, the detergent composition of the present invention is suitable for washing of the interior and exterior walls, floors, tatami (straw matting), ceiling and roof of a house; that of the wall and floor of kitchens, ranges, ventilators and kitchen utensils; that of furniture such as cupboards, bureaus, tables, desks, chairs and bookshelves; that of the surfaces of electrical appliances such as refrigerators, televisions, personal computers, stereos, air conditioners, microwave ovens, washing machines, dryers and lights; that of glass used in the windows and doors of a house, the door of furniture and car windows; that of window screens; that of the floor, wall and door of a toilet, a toilet seat with a syringe and that with a heater; that of the coated surfaces of an automobile, a bicycle and a motorcycle and the surfaces of plastic articles; that of automotive wheels; that of entrances and structures present in the neighborhood thereof, and exterior terraces, walls, fences and gates; and that of other hard surfaces having thereon particulate solid dirt. Further, the detergent composition of the present invention is also suitable for washing of the coated surface of a car body, the surfaces of automobile parts made of plastics, and the window glass and wheels of a car, particularly suitable for washing of a car body.

In carrying out the present invention, various additives may be added to the detergent composition, as far as the objective effects according to the present invention are not impaired. Examples of such additives include perfumes, pigments, dyes, microbiocides, fungicides, solubilizers, chelating agents, antioxidants, pH regulators, bleaching agents, viscosity depressants, dispersants and ultraviolet absorbers.

The detergent composition of the present invention can wash a hard surface having thereon a particulate solid dirt resulting from house dust, soil, earth sand and so on with the surface protected from being marred, even when the detergent composition is applied to the surface without pre-washing either by coating or spraying or by wiping with a material impregnated with the composition in an amount of as small as 50 g or below per square meter of the hard surface, and wiped off the surface with cloth, non-woven fabric, paper, sponge, leather, synthetic leather or like material.

EXAMPLE

The present invention will now be described in more detail by referring to the following Examples, though the present invention is not limited to them.

Example 1

Detergent compositions according to the present invention and those for comparison were prepared by the use of various kinds of globular particles listed in Table 1 and various components listed in Table 2.

More precisely, detergent compositions specified in Tables 7 to 10 were prepared according to the invention formulations 1 to 42 and comparative formulations 1 to 30 specified in Tables 3 to 6 wherein the globular particles listed in Table 1 were used as Component 1 and the balance was water. The obtained compositions were examined for anti-marring performance by the following method. The results are given in Tables 7 to 10. The compositions were examined also for viscosity at 20° C. and the results are given in Tables 11 to 14.

Method for Evaluating Anti-marring Performance In Washing by Wiping

A black acrylic plate was coated with a mixture comprising rapeseed oil and carbon black at a weight ratio of 9:1 in a coating weight of 1 g/$m^2$ and the resulting plate was dried at 60° C. for one month. A 0.1% ethanol dispersing solution of "Seven dusts for JIS test" (a product of IWAMOTO MINERAL CO.) was sprayed on the plate in an amount of 10 g/$m^2$ and dried at 60° C. for 24 hours. Then, each detergent composition was sprayed on the resulting plate in an amount of 10 g/$m^2$ and the resulting plate was wiped with a towel of cotton pile under a load of 10 g wt./$cm^2$ until the Seven dusts for JIS test had been removed completely.

The acrylic plate washed above with the detergent composition and that washed with water alone were examined for gloss at 60° (by the use of a gloss meter for mirror surfaces as described in JIS Z 8741) and the anti-marring index of the detergent composition was calculated by the following formula:

when the gloss of the initial acrylic plate is abbreviated to "$G_I$", that of the acrylic plate treated with water "$G_W$", and that of the acrylic plate treated with the detergent composition "$G_t$", anti-marring index (%)

$$= \left(1 - \frac{G_I - G_t}{G_I - G_W}\right) \times 100$$

TABLE 1

| Particle No. | Shape | Material | Mean diam. ($\mu$) | Surface energy (dyn/cm) | True sp. gr. | *3 Sphericity |
|---|---|---|---|---|---|---|
| B1 | globular particle | polyethylene | 3 | 33 | 0.98 | 98 |
| B2 | globular particle | polyvinyl chloride | 3 | 39 | 1.38 | 95 |
| B3 | globular particle | polyester | 3 | 43 | 1.38 | 97 |
| B4 | globular particle | high d.p. polydimethylsiloxane (silicone rubber) | 3 | 25 | 0.97 | 98 |
| B5 | globular particle | polystyrene | 2 | 35 | 1.05 | 100 |
| B6 | globular particle | acrylic ester/acrylic acid/ methacrylic ester/methacrylic acid/styrene copolymer*1 | 4 | 40 | 1.10 | 100 |
| B7 | globular particle | crosslinked acrylic ester/acrylic acid/methacrylic ester/methacrylic acid/styrene copolymer*2 | 3 | 41 | 1.15 | 100 |
| B8 | globular particle | crosslinked polymethacrylic ester | 3 | 39 | 1.21 | 100 |
| B9 | globular particle | polyurethane (polytetramethylene-hexamethyleneurethane) | 3 | 45 | 1.21 | 96 |
| B10 | globular particle | polyorganosilsesquioxane | 3 | 28 | 1.3 | 95 |
| B11 | globular particle | polyacetal | 3 | 42 | 1.18 | 100 |
| B12 | globular particle | polycarbonate (poly(bisphenol A carbonate)) | 3 | 43 | 1.19 | 97 |
| B13 | globular particle | silica | 3 | 76 | 2.2 | 95 |
| B14 | globular particle | porous silica | 3 | 76 | 2.0 | 91 |
| B15 | globular particle | silicone resin | 3 | 30 | 1.3 | 95 |

notes)
*1mole ratio 60/5/20/5/10.
MW: approximately 100,000
*2mole ratio 55/5/15/5/10/10(crosslinking agent: divinylbenzene)
*3each sphericity was determined by taking an electron micrograph of solid particles, selecting 100 projected images not overlapping each another at random, further selecting spherical projected images and projected images whose outlines were each completely included within the zone between its circumscribed circle and a circle being concentric with the circumscribed circle and having a radius of 90% of that of the circumscribed circle from among the 100 projected images and taking the total number of them as the spericity.

TABLE 2

| Component No. | Kind of component |
|---|---|
| Component 1 | various kinds of globular particles listed in Table 1 |
| Component 2 | diethyiene glycol monobutyl ether |
| Component 3 | diethylene glycol diethyl ether |
| Component 4 | propylene glycol monomethyl ether |
| Component 5 | propylene glycol monoethyl ether |
| Component 6 | dipropylene glycol monomethyl ether |
| Component 7 | phenyltriglycol |
| Component 8 | decane, b.p.: 174° C. |
| Component 9 | dodecane, b.p.: 215° C. |
| Component 10 | tetradecane, b.p.: 250° C. |
| Component 11 | isoparaffin, b.p.: 262° C. |
| Component 12 | dimethylsiloxane (50 cst) 25° C. |
| Component 13 | dimethylsiloxane (100 cst) 25° C. |
| Component 14 | dimethylsiloxane (200 cst) 25° C. |
| Component 15 | dimethylsiloxane (500 cst) 25° C. |
| Component 16 | dimethylsiloxane (1,000 cst) 25° C. |
| Component 17 | poly(diphenylsiloxane/phenylmethylsiloxane/ dimethylsiloxane)*1 |
| Component 18 | poly[N-(2-aminoethyl)-aminopropyl-methylsiloxane/dimethylsiloxane]*2 |
| Component 19 | polyethylene polydimethylsiloxane block *3 |
| Component 20 | poly(hydroxyalkylmethylsiloxane/ dimethylsiloxane)*4 |
| Component 21 | dicarboxyethylpolydimethylsiloxane*5 |
| Component 22 | bis(2,3-epoxypropyl)polydimethylsiloxane*6 |
| Component 23 | Na alkylbenzenesulfonate ($C_{12}$–$C_{14}$) |
| Component 24 | Na alkylsulfonate ($C_{12}$–$C_{14}$) |
| Component 25 | monoethanolamine salt of carboxyalkane ($C_{12}$–$C_{14}$) |
| Component 26 | monoethanolamine salt of carboxyalkene ($C_{18}$) |
| Component 27 | alkylglucoside ($C_{12}$–$C_{14}$) |
| Component 28 | polyacrylic acid |
| Component 29 | acrylic acid/maleic acid copolymer |
| Component 30 | polyvinylpyrrolidone |

notes)
*1poly(diphenylsiloxane/phenylmethylsiloxane/dimethylsiloxane) represented by the formula (IV), phenyl group/methyl group number ratio: 2/8, refractive index: 1.480, viscosity: 175 cst (25° C.), KF-54, a product of Shin-Etsu Chemical Co., Ltd.

(IV)

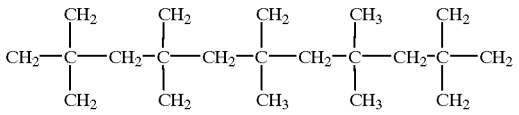

TABLE 2-continued

| Component No. | Kind of component |
|---|---|

(wherein a, b and c are each an integer of 0 or above, at least one of them being 1 or above)

*2poly[N-(2-aminoethyl)aminopropyl/methylsiloxane/dimethylsiloxane] represented by the formula (V), amino equivalent: 6,125 g/mol, refractive index: 1.403, viscosity: 60 cst (25° C.), KF-393, a product of Shin-Etsu Chemical Co., Ltd.

(V)

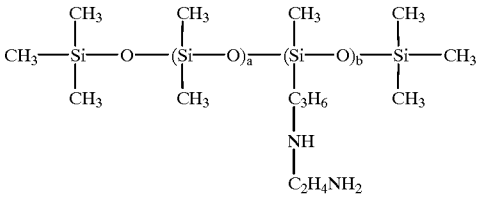

(wherein a is an integer of 0 or above, and b is an integer of 1 or above)

*3polyethylenepolydimethylsiloxane block polymer represented by the formula (VI), silicone/polyethylene composition ratio: 98/2 weight ratio), MW: approximately 2,000

(VI)

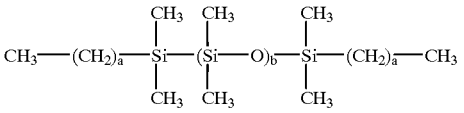

(wherein a is an integer of 40 to 50, and b is an integer of 0 or above)

*4poly(hydroxyalkylmethylsiloxane/dimethylsiloxane) represented by the formula (VII), viscosity: 170 cst (25° C.), refractive index: 1.412

TABLE 2-continued

| Component No. | Kind of component |
|---|---|

(VII)

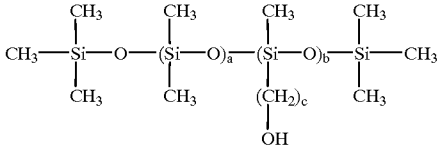

(wherein a/b = 40 and c is 30 on the average)

*5dicarboxyethylpolydimethylsiloxane represented by the formula (VIII), carboxy equivalent: 1,500 g/mol, refractive index: 1.402, viscosity: 100 cst (25° C.)

(VIII)

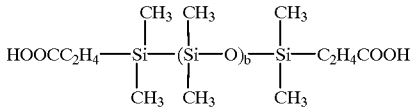

(wherein a is a number of 40 to 50, and b is an integer of 0 or above)

*6bis(2,3-epoxypropyl)polydimethylsiloxane represented by the formula (IX), epoxy equivalent: 2,790 g/mol, refractive index: 1.409, viscosity: 103 cst (25° C.)

(IX)

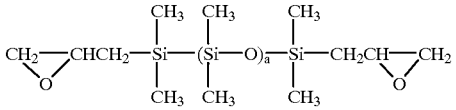

(wherein a is an integer of 1 or above)

TABLE 3

| | Component No. | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| Component (% by weight)* Comparative Formulation | | | | | | | | | | | | | | | | | | |
| 1 | 0 | | | | | | | | | | | | | | | | | |
| 2 | 0 | 5 | | | | | | | | | | | | | | | | |
| 3 | 0 | | 5 | | | | | | | | | | | | | | | |
| 4 | 0 | | | 5 | | | | | | | | | | | | | | |
| 5 | 0 | | | | 5 | | | | | | | | | | | | | |
| 6 | 0 | | | | | 5 | | | | | | | | | | | | |
| 7 | 0 | | | | | | 5 | | | | | | | | | | | |
| 8 | 0 | | | | | | | 5 | | | | | | | | | | |
| 9 | 0 | | | | | | | | 5 | | | | | | | | | |
| 10 | 0 | | | | | | | | | 5 | | | | | | | | |
| 11 | 0 | | | | | | | | | | 5 | | | | | | | |
| 12 | 0 | | | | | | | | | | | 5 | | | | | | |
| 13 | 0 | | | | | | | | | | | | 5 | | | | | |
| 14 | 0 | | | | | | | | | | | | | 5 | | | | |
| 15 | 0 | | | | | | | | | | | | | | 5 | | | |
| 16 | 0 | | | | | | | | | | | | | | | 5 | | |
| 17 | 0 | | | | | | | | | | | | | | | | 5 | |
| 18 | 0 | | | | | | | | | | | | | | | | | 5 |

TABLE 3-continued

| | Component No. | | | | | | | | | | | |
|---|---|---|---|---|---|---|---|---|---|---|---|---|
| | 19 | 20 | 21 | 22 | 23 | 24 | 25 | 26 | 27 | 28 | 29 | 30 |
| Component (% by weight)* Comparative Formulation | | | | | | | | | | | | |
| 1 | | | | | | | | | | | | |
| 2 | | | | | | | | | | | | |
| 3 | | | | | | | | | | | | |
| 4 | | | | | | | | | | | | |
| 5 | | | | | | | | | | | | |
| 6 | | | | | | | | | | | | |
| 7 | | | | | | | | | | | | |
| 8 | | | | | | | | | | | | |
| 9 | | | | | | | | | | | | |
| 10 | | | | | | | | | | | | |
| 11 | | | | | | | | | | | | |
| 12 | | | | | | | | | | | | |
| 13 | | | | | | | | | | | | |
| 14 | | | | | | | | | | | | |
| 15 | | | | | | | | | | | | |
| 16 | | | | | | | | | | | | |
| 17 | | | | | | | | | | | | |
| 18 | | | | | | | | | | | | |

TABLE 4

| | Component No. | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Component (% by weight)* | | | | | | | | | | | | | | | |
| Comparative formulation | | | | | | | | | | | | | | | |
| 19 | 0 | | | | | | | | | | | | | | |
| 20 | 0 | | | | | | | | | | | | | | |
| 21 | 0 | | | | | | | | | | | | | | |
| 22 | 0 | | | | | | | | | | | | | | |
| 23 | 0 | | | | | | | | | | | | | | |
| 24 | 0 | | | | | | | | | | | | | | |
| 25 | 0 | | | | | | | | | | | | | | |
| 26 | 0 | | | | | | | | | | | | | | |
| 27 | 0 | | | | | | | | | | | | | | |
| 28 | 0 | | | | | | | | | | | | | | |
| 29 | 0 | | | | | | | | | | | | | | |
| 30 | 0 | | | | | | | | | | | | | | |
| Invention formulation | | | | | | | | | | | | | | | |
| 1 | 10 | | | | | | | | | | | | | | |
| 2 | 10 | 5 | | | | | | | | | | | | | |
| 3 | 10 | | 5 | | | | | | | | | | | | |
| 4 | 10 | | | 5 | | | | | | | | | | | |
| 5 | 10 | | | | 5 | | | | | | | | | | |
| 6 | 10 | | | | | 5 | | | | | | | | | |

| | Component No. | | | | | | | | | | | | | | |
|---|---|---|---|---|---|---|---|---|---|---|---|---|---|---|---|
| | 16 | 17 | 18 | 19 | 20 | 21 | 22 | 23 | 24 | 25 | 26 | 27 | 28 | 29 | 30 |
| Component (% by weight)* | | | | | | | | | | | | | | | |
| Comparative formulation | | | | | | | | | | | | | | | |
| 19 | | | | 5 | | | | | | | | | | | |
| 20 | | | | | 5 | | | | | | | | | | |
| 21 | | | | | | 5 | | | | | | | | | |
| 22 | | | | | | | 5 | | | | | | | | |
| 23 | | | | | | | | 1 | | | | | | | |
| 24 | | | | | | | | | 1 | | | | | | |
| 25 | | | | | | | | | | 1 | | | | | |
| 26 | | | | | | | | | | | 1 | | | | |
| 27 | | | | | | | | | | | | 1 | | | |
| 28 | | | | | | | | | | | | | 0.1 | | |
| 29 | | | | | | | | | | | | | | 0.1 | |
| 30 | | | | | | | | | | | | | | | 0.1 |

TABLE 4-continued

| Invention formulation |
|---|
| 1 |
| 2 |
| 3 |
| 4 |
| 5 |
| 6 |

TABLE 5

| | Component No. | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Component (% by weight)* Inventive formulation | | | | | | | | | | | | | | | |
| 7 | 10 | | | | | | 5 | | | | | | | | |
| 8 | 10 | | | | | | | 5 | | | | | | | |
| 9 | 10 | | | | | | | | 5 | | | | | | |
| 10 | 10 | | | | | | | | | 5 | | | | | |
| 11 | 10 | | | | | | | | | | 5 | | | | |
| 12 | 10 | | | | | | | | | | | 5 | | | |
| 13 | 10 | | | | | | | | | | | | 5 | | |
| 14 | 10 | | | | | | | | | | | | | 5 | |
| 15 | 10 | | | | | | | | | | | | | | 5 |
| 16 | 10 | | | | | | | | | | | | | | |
| 17 | 10 | | | | | | | | | | | | | | |
| 18 | 10 | | | | | | | | | | | | | | |
| 19 | 10 | | | | | | | | | | | | | | |
| 20 | 10 | | | | | | | | | | | | | | |
| 21 | 10 | | | | | | | | | | | | | | |
| 22 | 10 | | | | | | | | | | | | | | |
| 23 | 10 | | | | | | | 5 | | | | | 5 | | |
| 24 | 10 | | | | | | | 5 | | | | | 5 | | |

| | Component No. | | | | | | | | | | | | | | |
|---|---|---|---|---|---|---|---|---|---|---|---|---|---|---|---|
| | 16 | 17 | 18 | 19 | 20 | 21 | 22 | 23 | 24 | 25 | 26 | 27 | 28 | 29 | 30 |
| Component (% by weight)* Inventive formulation | | | | | | | | | | | | | | | |
| 7 | | | | | | | | | | | | | | | |
| 8 | | | | | | | | | | | | | | | |
| 9 | | | | | | | | | | | | | | | |
| 10 | | | | | | | | | | | | | | | |
| 11 | | | | | | | | | | | | | | | |
| 12 | | | | | | | | | | | | | | | |
| 13 | | | | | | | | | | | | | | | |
| 14 | | | | | | | | | | | | | | | |
| 15 | | | | | | | | | | | | | | | |
| 16 | 5 | | | | | | | | | | | | | | |
| 17 | | 5 | | | | | | | | | | | | | |
| 18 | | | 5 | | | | | | | | | | | | |
| 19 | | | | 5 | | | | | | | | | | | |
| 20 | | | | | 5 | | | | | | | | | | |
| 21 | | | | | | 5 | | | | | | | | | |
| 22 | | | | | | | 5 | | | | | | | | |
| 23 | | | | | | | | 1 | | | | | | | |
| 24 | | | | | | | | | 1 | | | | | | |

TABLE 6

| | Component No. | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Component (% by weight)* Inventive formulation | | | | | | | | | | | | | | | |
| 25 | 10 | | | | | | | 5 | | | | | 5 | | |
| 26 | 10 | | | | | | | 5 | | | | | 5 | | |
| 27 | 10 | | | | | | | 5 | | | | | 5 | | |
| 28 | 10 | | | | | | | 5 | | | | | 5 | | |
| 29 | 10 | | | | | | | 5 | | | | | 5 | | |
| 30 | 10 | | | | | | | 5 | | | | | 5 | | |
| 31 | 10 | | | | | | | 5 | | | | | 5 | | |
| 32 | 10 | | | | | | | 5 | | | | | 5 | | |
| 33 | 10 | | | | | | | 5 | | | | | 5 | | |
| 34 | 10 | | | | | | | 5 | | | | | 3 | | |
| 35 | 10 | | | | | | | 5 | | | | | 3 | | |
| 36 | 10 | | | | | | | 5 | | | | | 3 | | |
| 37 | 10 | | | | | | | 5 | | | | | 4 | | |
| 38 | 10 | | | | | | | 5 | | | | | 4 | | |
| 39 | 10 | | | | | | | 5 | | | | | 4 | | |
| 40 | 10 | | | | | | | 5 | | | | | 3 | | |
| 41 | 10 | | | | | | | 5 | | | | | 3 | | |
| 42 | 10 | | | | | | | 5 | | | | | 3 | | |

| | Component No. | | | | | | | | | | | | | | |
|---|---|---|---|---|---|---|---|---|---|---|---|---|---|---|---|
| | 16 | 17 | 18 | 19 | 20 | 21 | 22 | 23 | 24 | 25 | 26 | 27 | 28 | 29 | 30 |
| Component (% by weight)* Inventive formulation | | | | | | | | | | | | | | | |
| 25 | | | | | | | | | | 1 | | | | | |
| 26 | | | | | | | | | | | 1 | | | | |
| 27 | | | | | | | | | | | | 1 | | | |
| 28 | | | | | | | | | | | | | 0.1 | | |
| 29 | | | | | | | | | | | | | | 0.1 | |
| 30 | | | | | | | | | | | | | | | 0.1 |
| 31 | | | | | | | | 1 | | | | | 0.1 | | |
| 32 | | | | | | | | 1 | | | | | | 0.1 | |
| 33 | | | | | | | | 1 | | | | | | | 0.1 |
| 34 | | 2 | | | | | | 1 | | | | | 0.1 | | |
| 35 | | 2 | | | | | | 1 | | | | | | 0.1 | |
| 36 | | 2 | | | | | | 1 | | | | | | | 0.1 |
| 37 | | | 1 | | | | | 1 | | | | | 0.1 | | |
| 38 | | | 1 | | | | | 1 | | | | | | 0.1 | |
| 39 | | | 1 | | | | | 1 | | | | | | | 0.1 |
| 40 | | 2 | 1 | | | | | 1 | | | | | 0.1 | | |
| 41 | | 2 | 1 | | | | | 1 | | | | | | 0.1 | |
| 42 | | 2 | 1 | | | | | 1 | | | | | | | 0.1 |

Note) *In the formulations specified in tables 3 to 6, the balance is water.

TABLE 7

| Comparative formulation No. | Anti-marring index |
|---|---|
| 1 | 0.0 (no particle added) |
| 2 | 2.5 (no particle added) |
| 3 | 3.1 (no particle added) |
| 4 | 1.7 (no particle added) |
| 5 | 3.4 (no particle added) |
| 6 | 4.2 (no particle added) |
| 7 | 5.1 (no particle added) |
| 8 | 6.3 (no particle added) |
| 9 | 7.1 (no particle added) |
| 10 | 8.2 (no particle added) |
| 11 | 7.3 (no particle added) |

TABLE 7-continued

| | Anti-marring index |
|---|---|
| 12 | 17.2 (no particle added) |
| 13 | 19.5 (no particle added) |
| 14 | 23.2 (no particle added) |
| 15 | 18.7 (no particle added) |
| 16 | 13.8 (no particle added) |
| 17 | 22.5 (no particle added) |
| 18 | 9.1 (no particle added) |

TABLE 8

| Comparative formulation No. | Anti-marring index |
|---|---|
| 19 | 17.5 (no particle added) |
| 20 | 16.9 (no particle added) |
| 21 | 8.7 (no particle added) |
| 22 | 23.1 (no particle added) |
| 23 | 10.2 (no particle added) |
| 24 | 11.3 (no particle added) |
| 25 | 15.4 (no particle added) |
| 26 | 18.2 (no particle added) |
| 27 | 8.5 (no particle added) |
| 28 | −2.9 (no particle added) |
| 29 | −6.5 (no particle added) |
| 30 | −3.7 (no particle added) |

| | Anti-marring index Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| Invention formulation No. | | | | | | | | | | | | | | | |
| 1 | 66.3 | 68.5 | 64.7 | 73.4 | 58.5 | 61.9 | 64.3 | 68.5 | 54.6 | 75.3 | 48.0 | 50.4 | 43.6 | 42.0 | 72.0 |
| 2 | 71.1 | 73.7 | 69.4 | 78.9 | 63.1 | 66.8 | 69.2 | 73.8 | 58.5 | 81.2 | 51.3 | 54.3 | 46.9 | 45.1 | 77.3 |
| 3 | 71.4 | 73.6 | 69.4 | 79.0 | 63.0 | 66.8 | 68.8 | 73.7 | 58.4 | 81.0 | 51.3 | 54.1 | 46.7 | 44.8 | 77.3 |
| 4 | 71.4 | 73.4 | 69.7 | 79.0 | 62.9 | 66.4 | 69.2 | 73.4 | 58.6 | 82.2 | 51.5 | 54.2 | 46.9 | 45.3 | 77.4 |
| 5 | 71.4 | 73.5 | 69.7 | 78.8 | 62.7 | 66.6 | 68.9 | 73.9 | 58.8 | 80.9 | 51.4 | 54.2 | 47.0 | 44.8 | 77.4 |
| 6 | 71.2 | 73.4 | 69.4 | 79.0 | 63.0 | 66.7 | 69.1 | 73.8 | 58.5 | 80.9 | 51.5 | 54.2 | 46.6 | 45.1 | 77.3 |

TABLE 9

| | Anti-marring index Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| Invention formulation No. | | | | | | | | | | | | | | | |
| 7 | 71.3 | 73.7 | 69.3 | 78.8 | 63.1 | 66.8 | 69.1 | 73.4 | 58.7 | 80.9 | 51.7 | 54.2 | 47.0 | 45.0 | 77.6 |
| 8 | 71.5 | 73.9 | 68.8 | 79.2 | 63.1 | 66.8 | 69.4 | 73.9 | 58.9 | 81.3 | 51.7 | 54.4 | 47.1 | 45.3 | 77.7 |
| 9 | 71.2 | 73.5 | 69.4 | 79.2 | 62.8 | 66.8 | 69.3 | 73.7 | 58.4 | 81.1 | 51.4 | 54.3 | 46.8 | 45.2 | 77.7 |
| 10 | 71.5 | 73.8 | 69.6 | 78.9 | 62.8 | 66.6 | 69.1 | 73.8 | 58.8 | 81.0 | 51.3 | 54.2 | 46.7 | 45.1 | 77.7 |
| 11 | 71.4 | 73.7 | 69.4 | 79.1 | 63.0 | 66.6 | 69.3 | 73.8 | 58.5 | 81.2 | 51.7 | 53.9 | 46.7 | 45.1 | 77.6 |
| 12 | 79.3 | 81.9 | 77.1 | 87.6 | 70.0 | 74.1 | 76.7 | 81.7 | 64.9 | 89.9 | 57.1 | 60.1 | 51.7 | 50.2 | 86.1 |
| 13 | 79.4 | 82.0 | 77.4 | 87.9 | 70.1 | 74.2 | 77.0 | 82.0 | 65.3 | 90.2 | 57.4 | 60.3 | 52.2 | 50.2 | 86.3 |
| 14 | 79.3 | 81.6 | 77.2 | 87.8 | 69.8 | 73.7 | 77.0 | 81.9 | 64.9 | 89.9 | 57.0 | 60.0 | 51.9 | 49.9 | 86.0 |
| 15 | 79.1 | 81.5 | 77.2 | 87.6 | 70.0 | 73.8 | 78.8 | 81.9 | 65.0 | 89.8 | 57.2 | 59.9 | 52.0 | 50.1 | 85.9 |
| 16 | 79.0 | 81.9 | 77.4 | 87.9 | 69.8 | 73.9 | 77.0 | 81.9 | 65.2 | 90.1 | 57.4 | 60.1 | 51.9 | 50.1 | 85.9 |
| 17 | 79.1 | 81.6 | 77.4 | 87.5 | 69.7 | 73.8 | 76.8 | 81.8 | 65.1 | 89.7 | 57.2 | 60.3 | 51.8 | 50.2 | 86.2 |
| 18 | 78.9 | 81.7 | 77.2 | 87.8 | 69.9 | 73.8 | 76.9 | 81.7 | 65.3 | 89.9 | 57.0 | 59.9 | 51.8 | 49.8 | 86.2 |
| 19 | 78.9 | 81.9 | 77.1 | 87.8 | 69.8 | 74.0 | 76.6 | 81.5 | 65.0 | 89.8 | 57.0 | 60.1 | 51.9 | 50.2 | 86.2 |
| 20 | 79.2 | 82.0 | 77.3 | 87.4 | 69.6 | 73.9 | 76.8 | 81.7 | 65.1 | 89.8 | 57.0 | 60.2 | 51.8 | 50.0 | 85.9 |
| 21 | 79.1 | 81.8 | 77.1 | 87.6 | 69.8 | 74.1 | 76.6 | 81.6 | 65.3 | 89.9 | 57.2 | 60.1 | 52.2 | 49.8 | 86.0 |
| 22 | 79.3 | 81.5 | 77.1 | 87.6 | 69.9 | 74.0 | 76.7 | 81.9 | 65.3 | 89.8 | 57.1 | 60.0 | 52.2 | 50.1 | 85.9 |
| 23 | 87.2 | 90.1 | 85.1 | 96.6 | 77.0 | 81.5 | 84.6 | 90.1 | 71.8 | 99.1 | 63.1 | 66.3 | 57.4 | 55.2 | 94.8 |
| 24 | 87.2 | 89.7 | 85.0 | 96.6 | 76.9 | 81.4 | 84.5 | 90.0 | 71.6 | 98.7 | 62.9 | 66.2 | 57.3 | 54.9 | 94.6 |

TABLE 10

| | Anti-marring index Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| Invention formulation No. | | | | | | | | | | | | | | | |
| 25 | 86.9 | 90.1 | 85.0 | 96.2 | 76.7 | 81.3 | 84.3 | 90.0 | 71.4 | 99.0 | 62.7 | 66.2 | 57.4 | 54.9 | 94.8 |
| 26 | 86.7 | 89.7 | 84.9 | 96.5 | 77.0 | 81.5 | 84.2 | 89.6 | 71.5 | 99.1 | 63.1 | 66.1 | 57.0 | 55.1 | 94.5 |
| 27 | 86.9 | 90.0 | 85.0 | 96.6 | 76.7 | 81.2 | 84.6 | 90.1 | 71.4 | 98.9 | 62.7 | 65.9 | 57.3 | 55.1 | 94.6 |
| 28 | 86.8 | 90.0 | 84.9 | 96.5 | 76.7 | 81.5 | 84.2 | 89.9 | 71.7 | 99.0 | 62.7 | 66.1 | 57.1 | 55.0 | 94.4 |
| 29 | 86.9 | 90.0 | 85.0 | 96.5 | 76.7 | 81.1 | 84.5 | 90.0 | 71.8 | 99.0 | 62.8 | 66.2 | 57.1 | 54.9 | 94.4 |
| 30 | 87.1 | 89.6 | 84.8 | 96.5 | 76.6 | 81.5 | 84.6 | 89.9 | 71.4 | 98.8 | 62.9 | 66.0 | 57.1 | 55.0 | 94.7 |
| 31 | 86.8 | 89.7 | 84.7 | 96.2 | 76.8 | 81.4 | 84.5 | 90.1 | 71.6 | 98.8 | 62.7 | 66.2 | 57.3 | 55.1 | 94.8 |
| 32 | 87.0 | 89.8 | 84.8 | 96.4 | 76.6 | 81.4 | 84.6 | 89.9 | 71.4 | 98.7 | 62.8 | 66.3 | 57.4 | 54.7 | 94.5 |
| 33 | 86.8 | 90.0 | 84.8 | 96.4 | 76.7 | 81.4 | 84.6 | 89.6 | 71.7 | 99.0 | 62.7 | 65.9 | 57.1 | 55.2 | 94.5 |
| 34 | 86.8 | 89.9 | 84.9 | 96.1 | 76.8 | 81.4 | 84.2 | 90.0 | 71.6 | 99.0 | 62.8 | 66.0 | 57.0 | 54.8 | 94.5 |
| 35 | 86.9 | 89.7 | 84.8 | 96.3 | 76.8 | 81.2 | 84.4 | 89.9 | 71.6 | 98.7 | 62.8 | 65.9 | 57.0 | 55.1 | 94.3 |
| 36 | 86.8 | 89.8 | 84.9 | 96.3 | 76.6 | 81.2 | 84.3 | 89.9 | 71.4 | 98.9 | 62.6 | 65.9 | 57.2 | 55.2 | 94.3 |
| 37 | 87.1 | 90.1 | 84.8 | 96.4 | 77.0 | 81.3 | 84.6 | 89.8 | 71.5 | 98.6 | 63.1 | 65.8 | 56.9 | 55.1 | 94.6 |
| 38 | 86.7 | 89.7 | 84.6 | 96.6 | 76.6 | 81.4 | 84.4 | 90.1 | 71.5 | 98.7 | 63.1 | 65.8 | 57.2 | 54.7 | 94.4 |
| 39 | 86.5 | 89.2 | 84.3 | 96.1 | 76.7 | 81.2 | 84.3 | 89.7 | 71.5 | 98.7 | 62.6 | 65.8 | 56.5 | 54.8 | 94.1 |
| 40 | 86.8 | 89.8 | 84.8 | 96.4 | 76.9 | 81.1 | 84.5 | 90.0 | 71.7 | 99.1 | 63.0 | 65.9 | 57.1 | 54.9 | 94.4 |
| 41 | 86.9 | 89.7 | 84.8 | 96.5 | 76.6 | 81.0 | 84.4 | 89.8 | 71.3 | 99.9 | 63.0 | 65.9 | 57.3 | 54.9 | 94.4 |
| 42 | 86.7 | 89.9 | 85.0 | 96.4 | 76.6 | 81.4 | 84.5 | 89.9 | 71.8 | 99.0 | 63.1 | 66.1 | 57.3 | 54.9 | 94.5 |

TABLE 11

| | Viscosity (cps) |
|---|---|
| Comparative fformulation No. | |
| 1 | 5.0 (no particle added) |
| 2 | 4.3 (no particle added) |
| 3 | 2.5 (no particle added) |
| 4 | 3.6 (no particle added) |
| 5 | 4.8 (no particle added) |
| 6 | 3.9 (no particle added) |
| 7 | 8.4 (no particle added) |

TABLE 11-continued

| | Viscosity (cps) |
|---|---|
| 8 | 2.1 (no particle added) |
| 9 | 8.6 (no particle added) |
| 10 | 10.5 (no particle added) |
| 11 | 25.0 (no particle added) |
| 12 | 20.0 (no particle added) |
| 13 | 23.1 (no particle added) |
| 14 | 32.1 (no particle added) |
| 15 | 62.3 (no particle added) |
| 16 | 121.5 (no particle added) |
| 17 | 23.1 (no particle added) |
| 18 | 35.1 (no particle added) |

TABLE 12

| | Vsicosity (cps) |
|---|---|
| Comparative formulation No. | |
| 19 | 129.5 (no particle added) |
| 20 | 65.1 (no particle added) |
| 21 | 53.2 (no particle added) |
| 22 | 12.3 (no particle added) |
| 23 | 5.2 (no particle added) |
| 24 | 4.9 (no particle added) |
| 25 | 5.6 (no particle added) |
| 26 | 6.1 (no particle added) |
| 27 | 5.4 (no particle added) |
| 28 | 526.0 (no particle added) |
| 29 | 621.0 (no particle added) |
| 30 | 853.0 (no particle added) |

TABLE 12-continued

| Invention formulation No. | Viscosity (cps) Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| 1 | 7.9 | 9.8 | 9.4 | 8.8 | 9.6 | 7.9 | 7.0 | 7.2 | 8.6 | 7.6 | 9.3 | 6.7 | 9.1 | 8.1 | 7.5 |
| 2 | 5.2 | 5.9 | 6.5 | 5.2 | 5.7 | 6.5 | 4.6 | 4.9 | 5.4 | 6.2 | 5.1 | 4.7 | 6.5 | 4.4 | 5.9 |
| 3 | 3.5 | 3.9 | 4.2 | 3.1 | 4.0 | 3.9 | 3.1 | 4.2 | 2.2 | 4.2 | 3.1 | 3.0 | 3.9 | 3.6 | 3.0 |
| 4 | 5.5 | 5.2 | 5.4 | 6.7 | 5.0 | 5.5 | 4.8 | 5.6 | 4.3 | 6.1 | 6.6 | 4.9 | 5.9 | 6.1 | 5.0 |
| 5 | 7.5 | 5.1 | 5.4 | 6.2 | 4.7 | 6.6 | 5.1 | 5.5 | 5.9 | 6.6 | 5.3 | 6.3 | 5.0 | 5.2 | 5.2 |
| 6 | 5.8 | 5.0 | 5.9 | 5.5 | 5.6 | 4.9 | 5.0 | 6.4 | 5.6 | 5.8 | 4.9 | 6.2 | 6.5 | 6.5 | 4.9 |

TABLE 13

| Invention formulation No. | Viscosity (cps) Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| 7 | 9.5 | 12.7 | 12.3 | 9.7 | 14.0 | 13.5 | 9.9 | 9.8 | 14.0 | 11.7 | 11.8 | 13.5 | 12.8 | 10.9 | 13.2 |
| 8 | 3.2 | 4.1 | 3.7 | 3.7 | 3.6 | 2.8 | 2.8 | 3.1 | 2.9 | 3.9 | 3.3 | 3.0 | 3.6 | 2.8 | 3.0 |
| 9 | 13.7 | 13.3 | 11.8 | 13.5 | 15.9 | 16.5 | 11.2 | 10.5 | 9.4 | 10.5 | 14.0 | 14.7 | 13.8 | 12.6 | 14.3 |
| 10 | 12.0 | 13.5 | 12.5 | 12.5 | 14.7 | 12.3 | 10.9 | 13.2 | 8.5 | 11.9 | 12.3 | 14.5 | 16.2 | 13.1 | 12.9 |
| 11 | 26.9 | 31.8 | 35.1 | 30.3 | 31.0 | 35.1 | 29.0 | 37.6 | 16.4 | 34.2 | 40.0 | 35.5 | 41.8 | 41.7 | 37.1 |
| 12 | 22.5 | 29.9 | 30.4 | 26.3 | 27.2 | 22.0 | 21.8 | 28.1 | 16.1 | 25.8 | 26.9 | 21.5 | 22.7 | 23.0 | 27.6 |
| 13 | 27.3 | 33.6 | 33.0 | 29.9 | 26.5 | 24.3 | 24.9 | 37.0 | 25.2 | 23.7 | 34.5 | 26.6 | 34.3 | 30.5 | 30.9 |
| 14 | 54.6 | 52.6 | 43.1 | 44.6 | 58.2 | 56.6 | 40.0 | 47.6 | 41.3 | 37.7 | 55.9 | 54.3 | 45.3 | 40.4 | 54.7 |
| 15 | 72.1 | 74.0 | 81.9 | 91.3 | 80.5 | 67.5 | 64.0 | 85.8 | 67.8 | 80.6 | 74.3 | 68.7 | 81.4 | 71.5 | 78.3 |
| 16 | 175.2 | 149.9 | 138.8 | 138.9 | 178.5 | 169.8 | 142.3 | 181.5 | 95.7 | 140.0 | 155.7 | 147.6 | 136.2 | 142.7 | 158.2 |
| 17 | 45.2 | 32.1 | 31.8 | 46.1 | 44.3 | 38.1 | 32.4 | 44.8 | 41.3 | 43.0 | 41.8 | 36.1 | 39.9 | 42.7 | 45.8 |
| 18 | 45.6 | 71.3 | 70.1 | 62.4 | 66.3 | 64.6 | 40.3 | 51.4 | 46.8 | 57.9 | 52.6 | 68.7 | 67.2 | 65.7 | 61.3 |
| 19 | 223.4 | 176.4 | 155.5 | 188.3 | 181.8 | 218.3 | 156.2 | 173.5 | 153.6 | 177.2 | 203.2 | 181.7 | 148.9 | 214.3 | 170.9 |
| 20 | 112.4 | 88.5 | 116.7 | 106.3 | 116.9 | 122.2 | 87.2 | 100.8 | 110.6 | 90.0 | 93.3 | 111.7 | 121.9 | 125.0 | 89.7 |
| 21 | 70.2 | 88.5 | 76.9 | 70.1 | 104.6 | 91.4 | 72.1 | 80.6 | 59.0 | 102.1 | 90.3 | 97.3 | 85.3 | 94.4 | 93.0 |
| 22 | 18.7 | 19.4 | 17.2 | 16.6 | 18.4 | 14.6 | 14.4 | 17.1 | 16.5 | 16.9 | 15.8 | 16.2 | 14.7 | 16.6 | 18.2 |
| 23 | 29.8 | 24.3 | 27.1 | 25.7 | 22.7 | 32.4 | 22.5 | 25.2 | 19.8 | 24.8 | 32.1 | 32.5 | 28.4 | 23.7 | 31.5 |
| 24 | 31.5 | 45.1 | 33.6 | 32.5 | 36.9 | 33.8 | 32.1 | 37.4 | 30.5 | 39.4 | 40.5 | 38.1 | 45.8 | 44.2 | 39.0 |

TABLE 14

| Invention formulation No. | Vsicosity (cps) Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| 25 | 21.6 | 28.1 | 24.8 | 27.3 | 26.3 | 27.8 | 22.8 | 21.2 | 18.1 | 25.9 | 26.6 | 28.3 | 26.2 | 31.7 | 29.3 |
| 26 | 15.5 | 17.1 | 17.6 | 13.5 | 13.4 | 18.6 | 12.9 | 15.3 | 14.1 | 16.2 | 16.7 | 18.1 | 15.1 | 11.7 | 12.2 |
| 27 | 35.6 | 43.9 | 39.7 | 43.6 | 34.4 | 31.9 | 31.5 | 43.5 | 38.8 | 32.9 | 30.8 | 37.9 | 33.0 | 42.7 | 42.1 |
| 28 | 286.3 | 267.7 | 368.9 | 372.7 | 261.5 | 325.1 | 269.0 | 273.3 | 290.0 | 209.1 | 302.7 | 313.8 | 301.6 | 243.7 | 363.4 |
| 29 | 257.7 | 298.1 | 267.3 | 312.9 | 370.6 | 314.1 | 263.0 | 283.2 | 246.1 | 310.4 | 331.2 | 269.9 | 372.6 | 356.4 | 385.8 |
| 30 | 238.8 | 245.8 | 187.8 | 204.8 | 173.5 | 236.0 | 182.0 | 255.3 | 166.2 | 215.4 | 237.9 | 189.2 | 196.6 | 215.2 | 215.5 |
| 31 | 410.6 | 367.4 | 420.7 | 340.3 | 322.0 | 297.8 | 295.9 | 348.4 | 345.8 | 412.5 | 282.1 | 363.5 | 434.9 | 310.1 | 379.6 |
| 32 | 409.2 | 364.1 | 391.9 | 347.2 | 410.2 | 270.8 | 289.3 | 317.9 | 238.4 | 296.7 | 331.8 | 362.1 | 295.7 | 275.9 | 290.5 |
| 33 | 206.4 | 289.3 | 241.1 | 285.2 | 191.9 | 210.0 | 200.2 | 254.1 | 284.4 | 267.7 | 229.8 | 246.6 | 236.4 | 255.9 | 290.9 |
| 34 | 298.2 | 292.1 | 289.6 | 337.7 | 380.5 | 322.3 | 260.4 | 348.8 | 188.6 | 368.5 | 370.8 | 359.5 | 353.9 | 359.5 | 269.3 |
| 35 | 337.1 | 326.3 | 261.6 | 294.0 | 273.6 | 311.7 | 254.6 | 339.5 | 239.3 | 288.4 | 251.5 | 309.0 | 327.8 | 248.2 | 346.7 |
| 36 | 233.9 | 217.3 | 202.0 | 192.6 | 254.5 | 212.1 | 176.2 | 263.0 | 178.4 | 194.3 | 188.1 | 212.8 | 224.0 | 188.9 | 202.1 |
| 37 | 387.1 | 318.7 | 386.2 | 376.4 | 406.3 | 386.1 | 291.6 | 390.1 | 357.9 | 334.9 | 293.9 | 372.2 | 287.1 | 353.7 | 332.2 |
| 38 | 283.5 | 352.2 | 398.7 | 370.3 | 348.8 | 335.6 | 285.1 | 366.1 | 234.4 | 358.8 | 309.2 | 293.0 | 324.1 | 372.1 | 417.0 |
| 39 | 225.5 | 213.7 | 237.1 | 221.6 | 197.9 | 220.3 | 197.3 | 254.9 | 112.3 | 279.9 | 247.6 | 211.5 | 239.3 | 234.2 | 263.3 |

TABLE 14-continued

| | Vsicosity (cps) Added particle No. | | | | | | | | | | | | | | |
|---|---|---|---|---|---|---|---|---|---|---|---|---|---|---|---|
| | B1 | B2 | B3 | B4 | B5 | B6 | B7 | B8 | B9 | B10 | B11 | B12 | B13 | B14 | B15 |
| 40 | 346.6 | 398.2 | 293.5 | 390.9 | 442.9 | 407.6 | 306.2 | 406.7 | 201.2 | 373.5 | 395.2 | 345.4 | 418.5 | 338.5 | 353.4 |
| 41 | 305.4 | 402.1 | 365.4 | 343.8 | 290.1 | 297.0 | 299.4 | 282.9 | 285.4 | 408.5 | 311.3 | 321.3 | 391.7 | 388.2 | 306.9 |
| 42 | 218.3 | 269.1 | 189.4 | 224.3 | 227.5 | 282.9 | 207.2 | 289.2 | 219.9 | 213.7 | 292.7 | 232.8 | 307.7 | 215.7 | 223.9 |

Example 2

Detergent compositions according to the present invention and those for comparison were prepared by using various kinds of particles listed in Tables 15 to 17 and various components listed in Table 18.

More precisely, detergent compositions specified in Tables 19 to 20 were prepared according to the formulations 1 to 37 specified in Tables 19 and 20 wherein the globular particles according to the present invention or comparative particles listed in Tables 15 to 17 were used as Component 31. The obtained compositions were examined for anti-marring performance by the same method as that employed in Example 1.

The results are given in Tables 21 to 26.

TABLE 15

| Particle No. | Shape | Material | Mean diam. (μm) | Surface energy (dyn/cm) | True sp. Gr. | Sphericity | |
|---|---|---|---|---|---|---|---|
| B1-1 | globular particle | polyethylene | 0.005 | 33 | 0.98 | 96 | Comp. |
| B1-2 | globular particle | polyethylene | 3 | | | 98 | Invention |
| B1-3 | globular particle | polyethylene | 20 | | | 91 | Comp. |
| B2-1 | globular particle | polyvinyl chloride | 0.005 | 39 | 1.38 | 96 | Comp. |
| B2-2 | globular particle | polyvinyl chloride | 3 | | | 98 | Invention |
| B2-3 | globular particle | polyvinyl chloride | 20 | | | 91 | Comp. |
| B3-1 | globular particle | polyester | 0.005 | 43 | 1.38 | 96 | Comp. |
| B3-2 | globular particle | polyester | 3 | | | 98 | Invention |
| B3-3 | globular particle | polyester | 20 | | | 91 | Comp. |
| B4-1 | globular particle | high d.p. polydimethylsiloxane (silicone rubber) | 0.005 | 25 | 0.97 | 97 | Comp. |
| B4-2 | globular particle | high d.p. polydimethylsiloxane (silicone rubber) | 3 | | | 98 | Invention |
| B4-3 | globular particle | high d.p. polydimethylsiloxane (silicone rubber) | 20 | | | 90 | Comp. |
| B5-1 | globular particle | polystyrene | 0.005 | 35 | 1.05 | 97 | Comp. |
| B5-2 | globular particle | polystyrene | 0.01 | | | 98 | Invention |
| B5-3 | globular particle | polystyrene | 0.1 | | | 99 | Invention |
| B5-4 | globular partcile | polystyrene | 0.5 | | | 98 | Invention |
| B5-5 | globular particle | polystyrene | 2 | | | 100 | Invention |
| B5-6 | globular particle | polystyrene | 4 | | | 100 | Invention |
| B5-7 | globular particle | polystyrene | 10 | | | 95 | Invention |
| B5-8 | globular particle | polystyrene | 20 | | | 92 | Comp. |
| B6-1 | globular particle | acrylic ester/acrylic acid/methacrylic ester/methacrylic acid/styrene copolymer*1 | 0.005 | 40 | 1.10 | 97 | Comp. |
| B6-2 | globular particle | acrylic ester/acrylic acid/methacrylic | 0.01 | | | 100 | Invention |

TABLE 15-continued

| Particle No. | Shape | Material | Mean diam. (μm) | Surface energy (dyn/cm) | True sp. Gr. | Sphericity | |
|---|---|---|---|---|---|---|---|
| | | ester/methacrylic acid/styrene copolymer*1 | | | | | |
| B6-3 | globular particle | acrylic ester/acrylic acid/methacrylic ester/methacrylic acid/styrene copolymer*1 | 0.1 | 40 | 1.10 | 100 | Invention |
| B6-4 | globular particle | acrylic ester/acrylic acid/methacrylic ester/methacrylic acid/styrene copolymer*1 | 0.5 | | | 100 | Invention |
| B6-5 | globular particle | acrylic ester/acrylic acid/methacrylic ester/methacrylic acid/styrene copolymer*1 | 2 | | | 100 | Invention |
| B6-6 | globular particle | acrylic ester/acrylic acid/methacrylic ester/methacrylic acid/styrene copolymer*1 | 4 | | | 99 | Invention |
| B6-7 | globular particle | acrylic ester/acrylic acid/methacrylic ester/methacrylic acid/styrene copolymer*1 | 10 | | | 96 | Invention |
| B6-8 | globular particle | acrylic/acrylic acid/methacrylate/methacrylic acid/styrene copolymer | 20 | | | 90 | Comp. |

*1mole ratio 60/5/20/5/10, MW: ca. 100,000

TABLE 16

| Particle No. | Shape | Material | Mean diam. (μm) | Surface energy (dyn/cm) | True sp. Gr. | Sphericity | |
|---|---|---|---|---|---|---|---|
| B7-1 | globular particle | crosslinked acrylic ester/acrylic acid/methacrylic ester/methacrylic acid/styrene copolymer*2 | 0.005 | 41 | 1.15 | 99 | Comp. |
| B7-2 | globular particle | crosslinked acrylic ester/acrylic acid/methacrylic ester/methacrylic acid/styrene copolymer*2 | 3 | | | 100 | Invent. |
| B7-3 | globular particle | crosslinked acrylic ester/acrylic acid/methacrylic ester/methacrylic acid/styrene copolymer*2 | 20 | | | 95 | Comp. |
| B8-1 | globular particle | crosslinked methacrylic ester | 0.005 | 39 | 1.21 | 98 | Comp. |
| B8-2 | globular particle | crosslinked methacrylic ester | 3 | | | 100 | Invent. |
| B8-3 | globular particle | crosslinked methacrylic ester | 20 | | | 93 | Comp. |
| B9-1 | globular particle | polyurethane (polytetramethylene-hexamethyleneurethane | 0.005 | 45 | 1.21 | 92 | Comp. |
| B9-2 | globular particle | polyurethane (polytetramethylene-hexamethyleneurethane | 3 | | | 96 | Invention |
| B9-3 | globular particle | polyurethane (polytetramethylene-hexamethyleneurethane | 20 | | | 90 | Comp. |
| B10-1 | globular particle | polyorganosilsesqui-oxane | 0.05 | 28 | 1.3 | 90 | Comp. |
| B10-2 | globular particle | polyorganosilsesqui-oxane | 3 | | | 95 | Invention |

TABLE 16-continued

| Particle No. | Shape | Material | Mean diam. (μm) | Surface energy (dyn/cm) | True sp. Gr. | Sphericity | |
|---|---|---|---|---|---|---|---|
| B10-3 | globular particle | polyorganosilsesqui-oxane | 20 | | | 91 | Comp. |
| B11-1 | globular particle | polyacetal | 0.005 | 42 | 1.18 | 98 | Comp. |
| B11-2 | globular particle | polyacetal | 3 | | | 100 | Invention |
| B11-3 | globualr particle | polyacetal | 20 | | | 99 | Comp. |
| B12-1 | globular particle | polycarbonate [poly(bisphenol A carbonate)] | 0.005 | 43 | 1.19 | 96 | Comp. |
| B12-2 | globular particle | polycarbonate [poly(bisphenol A carbonate)] | 3 | | | 97 | Invention |
| B12-3 | globular particle | polycarbonate [poly(bisphenol A carbonate)] | 20 | | | 91 | Comp. |
| B13-1 | globular particle | silica | 0.005 | 76 | 2.3 | 91 | Cornp. |
| B13-2 | globular particle | silica | 3 | | | 95 | Invention |
| B13-3 | globular particle | silica | 20 | | | 94 | Comp. |
| B14-1 | globular particle | porous silica | 0.005 | 76 | 2.0 | 90 | Comp. |
| B14-2 | globular particle | porous silica | 3 | | | 91 | Invention |
| B14-3 | globular particle | porous silica | 20 | | | 90 | Comp. |
| B15-1 | globular particle | silicone resin | 0.005 | 30 | 1.3 | 92 | Comp. |
| B15-2 | globular particle | silicone resin | 3 | | | 95 | Invention |
| B15-3 | globular particle | silicone resin | 20 | | | 91 | Comp. |

*2mole ratio 55/5/15/5/10/10(crosslinking agent, divinylbenzene)

TABLE 17

| Particle No. | Shape | Material | Mean diam. (μm) | Surface energy (dyn/cm) | True sp. Gr. | Sphericity | |
|---|---|---|---|---|---|---|---|
| R1 | irregular particle | polyethylene | 3 | 33 | 0.98 | 38 | Comp. |
| R2 | irregular particle | polyvinyl chloride | 3 | 39 | 1.38 | 42 | Comp. |
| R3 | irregular particle | polyester | 3 | 43 | 1.38 | 53 | Comp. |
| R4 | irregular particle | high d.p. polydimethylsiloxa ne (silicone rubber) | 3 | 25 | 0.97 | 85 | Comp. |
| R5 | irregular particle | polystyrene | 3 | 35 | 1.05 | 61 | Comp. |
| R6 | irregular particle | acrylic ester/acrylic acid/methacrylic ester/methacrylic acid/styrene copolymer*1 | 3 | 40 | 1.10 | 53 | Comp. |
| R7 | irregular particle | crosslinked acrylic ester/acrylic acid/methacrylic ester/methacrylic acid/styrene copolymer*2 | 3 | 41 | 1.15 | 65 | Comp. |
| R8 | irregular particle | crosslinked methacrylic ester | 3 | 39 | 1.21 | 57 | Comp. |
| R9 | irregular particle | polyurethane (polytetramethylen | 3 | 45 | 1.21 | 43 | Comp. |

TABLE 17-continued

| Particle No. | Shape | Material | Mean diam. (μm) | Surface energy (dyn/cm) | True sp. Gr. | Sphericity | |
|---|---|---|---|---|---|---|---|
| | | ehexamethylene-urethane) | | | | | |
| R10 | irregular particle | polyorgano-silsesquioxane | 3 | 28 | 1.3 | 81 | Comp. |
| R11 | irregular particle | polyacetal | 3 | 42 | 1.18 | 52 | Comp. |
| R12 | irregular particle | polycarbonate [poly(bisphenol A carbonate)] | 3 | 43 | 1.19 | 38 | Comp. |
| R13 | irregular particle | silica | 3 | 76 | 2.2 | 25 | Comp. |
| R14 | irregular particle | porous silica | 3 | 76 | 2.2 | 18 | Comp. |
| R15 | irregular particle | silicone resin | 3 | 30 | 1.3 | 83 | Comp. |
| R16 | irregular particle | alumina | 3 | 78 | 2.7 | 16 | Comp. |
| R17 | irregular particle | bentonite | 3 | 81 | — | 15 | Comp. |
| R18 | irregular particle | talc | 3 | 73 | — | 18 | Comp. |

*1mole ratio 60/5/20/5/10, MW: ca. 100,000
*2mole ratio 55/5/15/5/10/10 (divinylbenzene, crosslinking agent)

TABLE 18

| Component No. | Kind of component |
|---|---|
| Component 31 | various kinds of particles listed in Tables 15 to 17 |
| Component 32 | diethylene glycol monoethyl ether |
| Component 33 | diethylene glycol monobutyl ether |
| Component 34 | diethylene glycol dimethyl ether |
| Component 35 | diethylene glycol diethyl ether |
| Component 36 | propylene glycol monomethyl ether |
| Component 37 | propylene glyaol monoethyl ether |
| Component 38 | dipropylene glycol monomethyl ether |
| Component 39 | dipropylene glycol monoethyl ether |
| Component 40 | dipropylene glycol dimethyl ether |
| Component 41 | phenyltriglycol |
| Component 42 | hexane, b.p.: 68° C. |
| Component 43 | decane, b.p.: 174° C. |
| Component 44 | dodecane, b.p.: 215° C. |
| Component 45 | tetradecane, b.p.: 250° C. |
| Component 46 | isoparaffin, b.p.: 262° C. |
| Component 47 | dimethylsiloxane (100 cst 25° C.) |
| Component 48 | dimethylsiloxane (200 cst 25° C.) |
| Component 49 | dimethylsiloxane (500 cst 25° C.) |
| Component 50 | dimethylsiloxane (1,000 cst 25° C.) |
| Component 51 | poly(diphenylsiloxane/phenylmethylsiloxane /dimethylsiloxane)*1 |
| Component 52 | poly[N-(2-aminoethyl)aminopropyl-methylsiloxane/dimethylsiloxane]*2 |
| Component 53 | polyethylene/polydimethylsiloxane block polymer*3 |
| Component 54 | poly(hydroxyalkylmethylsiloxane/ dimethylsiloxane)*4 |
| Component 55 | dicarboxyethylpolydimethylsiloxane*5 |
| Component 56 | poly(methylpolyoxyethylenepropyl-methylsiloxane/dimethylsiloxane)*7 |
| Component 57 | bis(2,3-epoxypropyl)polydimethylsiloxane*6 |
| Component 58 | poly(carboxyethylmethylsiloxane-N-(2-aminoethyl)aminopropylmethylsiloxane/ dimethylsiloxane)*8 |

TABLE 18-continued

| Component No. | Kind of component |
|---|---|

notes)

*1 to *6the same as described in Table 2.

*7poly(methylpolyoxyethylenepropyl-methylsiloxane/dimethylsiloxane) represented by the formula (X), viscosity: 320 cst (25° C.), refractive index: 1.439

(X)

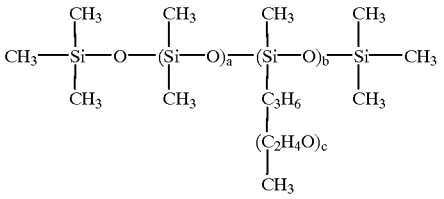

(wherein a is 3 to 10, b is 1 to 3, and c is 10 to 17)

*8poly(carboxyethylmethylsiloxane-N-(2-aminoethyl) aminopropylmethylsiloxane-dimethylsiloxane) represented by the formula (XI), 100 cst (25° C.)

(XI)

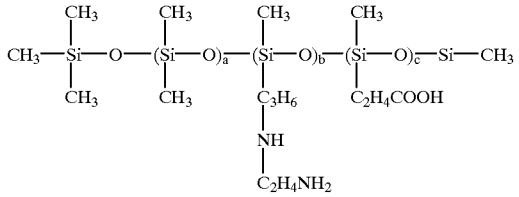

(wherein a is 3 to 10, b is 1 to 3, and c is 1 to 3)

TABLE 19

| Formul. | Component No. | | | | | | | | | | | | | | | | | | | | | | | | | | |
|---|---|---|---|---|---|---|---|---|---|---|---|---|---|---|---|---|---|---|---|---|---|---|---|---|---|---|---|
| No. | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 |
| Formulation (% by wt.) | | | | | | | | | | | | | | | | | | | | | | | | | | | | |
| 1 | 10 | 5 | | | | | | | | | | | | | | | 5 | | | | | | | | | | | |
| 2 | 10 | | 5 | | | | | | | | | | | | | | 5 | | | | | | | | | | | |
| 3 | 10 | | | 5 | | | | | | | | | | | | | 5 | | | | | | | | | | | |
| 4 | 10 | | | | 5 | | | | | | | | | | | | 5 | | | | | | | | | | | |
| 5 | 10 | | | | | 5 | | | | | | | | | | | 5 | | | | | | | | | | | |
| 6 | 10 | | | | | | 5 | | | | | | | | | | 5 | | | | | | | | | | | |
| 7 | 10 | | | | | | | 5 | | | | | | | | | 5 | | | | | | | | | | | |
| 8 | 10 | | | | | | | | 5 | | | | | | | | 5 | | | | | | | | | | | |
| 9 | 10 | | | | | | | | | 5 | | | | | | | 5 | | | | | | | | | | | |
| 10 | 10 | | | | | | | | | | 5 | | | | | | 5 | | | | | | | | | | | |
| 11 | 10 | | | | | | | | | | | 5 | | | | | 5 | | | | | | | | | | | |
| 12 | 10 | | | | | | | | | | | | 5 | | | | 5 | | | | | | | | | | | |
| 13 | 10 | | | | | | | | | | | | | 5 | | | 5 | | | | | | | | | | | |
| 14 | 10 | | | | | | | | | | | | | | 5 | | 5 | | | | | | | | | | | |
| 15 | 10 | | | | | | | | | | | | | | | 5 | 5 | | | | | | | | | | | |
| 16 | 10 | | | | | | | | | 5 | | | | | | | | 5 | | | | | | | | | | |
| 17 | 10 | | | | | | | | | 5 | | | | | | | | | 5 | | | | | | | | | |
| 18 | 10 | | | | | | | | | 5 | | | | | | | | | | 5 | | | | | | | | |

TABLE 20

| Formul. | Component No. | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| No. | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 |
| Formulation (% by wt.) | | | | | | | | | | | | | | | | | | | | | | | | | | | | |
| 19 | 10 | | | | | | | | | 5 | | | | | | | | | | | 5 | | | | | | | |
| 20 | 10 | | | | | | | | | 5 | | | | | | | | | | | | 5 | | | | | | |
| 21 | 10 | | | | | | | | | 5 | | | | | | | | | | | | | 5 | | | | | |
| 22 | 10 | | | | | | | | | 5 | | | | | | | | | | | | | | 5 | | | | |
| 23 | 10 | | | | | | | | | 5 | | | | | | | | | | | | | | | 5 | | | |
| 24 | 10 | | | | | | | | | 5 | | | | | | | | | | | | | | | | 5 | | |
| 25 | 10 | | | | | | | | | 5 | | | | | | | | | | | | | | | | | 5 | |
| 26 | 10 | | | | | | | | | 5 | | | | | | | | | | | | | | | | | | 5 |
| 27 | 10 | | | | | | | | | | | | 5 | | | | | 5 | | | | | | | | | | |
| 28 | 10 | | | | | | | | | | | | 5 | | | | | | 5 | | | | | | | | | |
| 29 | 10 | | | | | | | | | | | | 5 | | | | | | | 5 | | | | | | | | |
| 30 | 10 | | | | | | | | | | | | 5 | | | | | | | | 5 | | | | | | | |
| 31 | 10 | | | | | | | | | | | | 5 | | | | | | | | | 5 | | | | | | |
| 32 | 10 | | | | | | | | | | | | 5 | | | | | | | | | | 5 | | | | | |
| 33 | 10 | | | | | | | | | | | | 5 | | | | | | | | | | | 5 | | | | |
| 34 | 10 | | | | | | | | | | | | 5 | | | | | | | | | | | | 5 | | | |
| 35 | 10 | | | | | | | | | | | | 5 | | | | | | | | | | | | | 5 | | |
| 36 | 10 | | | | | | | | | | | | 5 | | | | | | | | | | | | | | 5 | |
| 37 | 10 | | | | | | | | | | | | 5 | | | | | | | | | | | | | | | 5 |

note) *In the formulations specified in Table 19 and 20, the balance is water

TABLE 21

| | Anti-marring index Evaluated Formulation No. by Addition of various particles | | | | | | | | | | | | |
|---|---|---|---|---|---|---|---|---|---|---|---|---|---|
| Particle No. | 1 | 2 | 3 | 4 | 5 | 6 | 7 | 8 | 9 | 10 | 11 | 12 | 13 |
| B1-1 | 24.0 | 24.8 | 24.4 | 23.1 | 24.3 | 24.5 | 22.7 | 23.7 | 25.1 | 22.2 | 19.0 | 25.6 | 26.1 |
| B1-2 | 80.1 | 82.8 | 81.4 | 77.0 | 80.9 | 81.8 | 75.7 | 79.2 | 83.5 | 73.9 | 63.5 | 85.3 | 87.0 |
| B1-3 | 28.0 | 29.0 | 28.5 | 26.9 | 28.3 | 28.6 | 26.5 | 27.7 | 29.2 | 25.9 | 22.2 | 29.8 | 30.5 |
| B2-1 | 24.7 | 25.5 | 25.1 | 23.7 | 25.0 | 25.2 | 23.4 | 24.4 | 25.8 | 22.8 | 19.6 | 26.3 | 26.9 |
| B2-2 | 82.3 | 85.2 | 83.8 | 79.2 | 83.2 | 84.1 | 77.9 | 81.4 | 85.9 | 76.1 | 65.3 | 87.7 | 89.5 |

TABLE 21-continued

| | Anti-marring index Evaluated Formulation No. by Addition of various particles | | | | | | | | | | | | |
|---|---|---|---|---|---|---|---|---|---|---|---|---|---|
| Particle No. | 1 | 2 | 3 | 4 | 5 | 6 | 7 | 8 | 9 | 10 | 11 | 12 | 13 |
| B2-3 | 28.8 | 29.8 | 29.3 | 27.7 | 29.1 | 29.4 | 27.2 | 28.5 | 30.1 | 26.6 | 22.8 | 30.7 | 31.3 |
| B3-1 | 23.5 | 24.3 | 23.8 | 22.6 | 23.7 | 24.0 | 22.1 | 23.2 | 24.5 | 21.6 | 18.6 | 25.0 | 25.5 |
| B3-2 | 78.2 | 81.0 | 79.6 | 75.2 | 79.1 | 79.9 | 74.0 | 77.4 | 81.6 | 72.3 | 62.1 | 83.3 | 85.1 |
| B3-3 | 27.3 | 28.3 | 27.8 | 26.3 | 27.7 | 28.0 | 25.9 | 27.1 | 28.5 | 25.3 | 21.7 | 29.1 | 29.8 |
| B4-1 | 26.5 | 27.4 | 26.9 | 25.5 | 26.8 | 27.0 | 25.0 | 26.2 | 27.6 | 24.5 | 21.0 | 28.2 | 28.8 |
| B4-2 | 88.3 | 91.3 | 89.8 | 84.9 | 89.2 | 90.1 | 83.4 | 87.3 | 92.1 | 81.5 | 70.0 | 94.0 | 95.9 |
| B4-3 | 30.9 | 31.9 | 31.4 | 29.7 | 31.2 | 31.5 | 29.2 | 30.5 | 32.2 | 28.5 | 24.5 | 32.9 | 33.6 |
| B5-1 | 28.7 | 29.7 | 29.2 | 27.6 | 29.0 | 29.4 | 27.2 | 28.4 | 30.0 | 26.5 | 22.8 | 30.6 | 31.3 |
| B5-2 | 49.6 | 51.3 | 50.4 | 47.7 | 50.1 | 50.7 | 46.9 | 49.1 | 51.7 | 45.8 | 39.4 | 52.8 | 53.9 |
| B5-3 | 56.0 | 58.0 | 57.0 | 53.9 | 56.6 | 57.2 | 53.0 | 55.4 | 58.5 | 51.8 | 44.5 | 59.7 | 60.9 |
| B5-4 | 61.8 | 64.0 | 62.9 | 59.4 | 62.5 | 63.2 | 58.4 | 61.1 | 64.5 | 57.1 | 49.0 | 65.8 | 67.2 |
| B5-5 | 71.8 | 74.3 | 73.1 | 69.1 | 72.6 | 73.4 | 68.0 | 71.1 | 75.0 | 66.4 | 57.0 | 76.5 | 78.1 |
| B5-6 | 70.4 | 72.9 | 71.6 | 67.7 | 71.2 | 71.9 | 66.6 | 69.6 | 73.5 | 65.0 | 55.9 | 75.0 | 76.6 |
| B5-7 | 58.9 | 61.0 | 59.9 | 56.7 | 59.6 | 60.2 | 55.7 | 58.3 | 61.5 | 54.5 | 46.8 | 62.8 | 64.1 |
| B5-8 | 36.7 | 37.9 | 37.3 | 35.2 | 37.0 | 37.4 | 34.6 | 36.2 | 38.2 | 33.8 | 29.0 | 39.0 | 39.8 |
| B6-1 | 38.2 | 39.5 | 38.8 | 36.7 | 38.6 | 39.0 | 36.1 | 37.8 | 39.8 | 35.3 | 30.3 | 40.7 | 41.5 |
| B6-2 | 57.3 | 59.3 | 58.3 | 55.1 | 57.9 | 58.5 | 54.2 | 56.7 | 59.8 | 52.9 | 45.4 | 61.1 | 62.3 |
| B6-3 | 65.7 | 68.0 | 66.9 | 63.2 | 66.4 | 67.1 | 62.1 | 65.0 | 68.6 | 60.7 | 52.1 | 70.0 | 71.4 |
| B6-4 | 68.0 | 70.4 | 69.2 | 65.4 | 68.7 | 69.5 | 64.3 | 67.3 | 71.0 | 62.8 | 54.0 | 72.4 | 73.9 |
| B6-5 | 76.4 | 79.0 | 77.8 | 73.5 | 77.2 | 78.1 | 72.2 | 75.6 | 79.7 | 70.6 | 60.6 | 81.4 | 83.1 |
| B6-6 | 74.9 | 77.5 | 76.2 | 72.0 | 75.7 | 76.5 | 70.8 | 74.0 | 78.2 | 69.2 | 59.4 | 79.8 | 81.4 |
| B6-7 | 65.5 | 68.8 | 67.6 | 63.9 | 67.2 | 67.9 | 62.9 | 65.8 | 69.3 | 61.4 | 52.7 | 70.8 | 72.3 |
| B6-8 | 33.3 | 34.4 | 33.8 | 32.0 | 33.6 | 34.0 | 31.5 | 32.9 | 34.7 | 30.7 | 26.4 | 35.4 | 36.2 |
| B7-1 | 23.2 | 24.0 | 23.6 | 22.3 | 23.4 | 23.7 | 21.9 | 22.9 | 24.2 | 21.4 | 18.4 | 24.7 | 25.2 |
| B7-2 | 77.3 | 80.0 | 78.7 | 74.4 | 78.1 | 79.0 | 73.1 | 76.5 | 80.7 | 71.4 | 61.3 | 82.4 | 84.1 |
| B7-3 | 27.0 | 28.0 | 27.5 | 26.0 | 27.3 | 27.6 | 25.6 | 26.8 | 28.2 | 25.0 | 21.4 | 28.8 | 29.4 |
| B8-1 | 24.8 | 25.7 | 25.3 | 23.9 | 25.1 | 25.4 | 23.5 | 24.5 | 25.9 | 22.9 | 19.7 | 26.4 | 27.0 |
| B8-2 | 82.8 | 85.6 | 84.2 | 79.6 | 83.7 | 84.6 | 78.3 | 81.9 | 86.4 | 76.5 | 65.7 | 88.2 | 90.0 |
| B8-3 | 29.0 | 30.0 | 29.5 | 27.9 | 29.3 | 29.6 | 27.4 | 28.7 | 30.2 | 26.7 | 23.0 | 30.8 | 31.5 |
| B9-1 | 19.6 | 20.3 | 20.0 | 18.9 | 19.9 | 20.1 | 18.6 | 19.4 | 20.5 | 18.1 | 15.6 | 20.9 | 21.4 |
| B9-2 | 65.5 | 67.8 | 66.6 | 63.0 | 66.2 | 66.9 | 61.9 | 64.8 | 68.3 | 60.5 | 51.9 | 69.7 | 71.2 |
| B9-3 | 22.9 | 23.7 | 23.3 | 22.0 | 23.2 | 23.4 | 21.6 | 22.7 | 23.9 | 21.2 | 18.2 | 24.4 | 24.9 |
| B10-1 | 27.3 | 28.2 | 27.8 | 26.2 | 27.6 | 27.9 | 25.8 | 27.0 | 28.4 | 25.2 | 21.6 | 29.0 | 29.7 |
| B10-2 | 90.9 | 94.1 | 92.5 | 87.5 | 91.9 | 92.9 | 86.0 | 90.0 | 94.9 | 84.1 | 72.2 | 96.9 | 98.9 |
| B10-3 | 31.8 | 32.9 | 32.4 | 30.6 | 32.2 | 32.5 | 30.1 | 31.5 | 33.2 | 29.4 | 25.3 | 33.9 | 34.6 |

TABLE 22

| | Anti-marring index Evaluated Formulation No. by Addition of various particles | | | | | | | | | | | |
|---|---|---|---|---|---|---|---|---|---|---|---|---|
| Particle No. | 14 | 15 | 16 | 17 | 18 | 19 | 20 | 21 | 22 | 23 | 24 | 25 |
| B1-1 | 22.4 | 25.3 | 25.8 | 25.3 | 23.0 | 26.1 | 23.7 | 25.5 | 25.3 | 23.7 | 24.0 | 25.4 |
| B1-2 | 74.8 | 84.4 | 86.1 | 84.4 | 76.6 | 87.0 | 79.2 | 85.3 | 84.4 | 79.2 | 80.1 | 84.8 |
| B1-3 | 26.2 | 29.5 | 30.1 | 29.5 | 26.8 | 30.4 | 27.7 | 29.8 | 29.5 | 27.7 | 28.0 | 29.7 |
| B2-1 | 23.1 | 26.0 | 26.5 | 26.0 | 23.6 | 26.8 | 24.4 | 26.3 | 26.0 | 24.4 | 24.7 | 26.2 |
| B2-2 | 76.9 | 86.8 | 88.6 | 86.8 | 78.7 | 89.5 | 81.4 | 87.7 | 86.8 | 81.4 | 82.3 | 87.3 |
| B2-3 | 26.9 | 30.4 | 31.0 | 30.4 | 27.5 | 31.3 | 28.5 | 30.7 | 30.4 | 28.5 | 28.8 | 30.5 |
| B3-1 | 21.9 | 24.7 | 25.2 | 24.7 | 22.4 | 25.5 | 23.2 | 25.0 | 24.7 | 23.2 | 23.5 | 24.9 |
| B3-2 | 73.1 | 82.5 | 84.2 | 82.5 | 74.8 | 85.0 | 77.4 | 83.3 | 82.5 | 77.4 | 78.2 | 82.9 |
| B3-3 | 25.6 | 28.9 | 29.5 | 28.8 | 26.2 | 29.7 | 27.1 | 29.1 | 28.9 | 27.1 | 27.4 | 29.0 |
| B4-1 | 24.7 | 27.9 | 28.4 | 27.9 | 25.3 | 28.7 | 26.1 | 28.2 | 27.9 | 26.2 | 26.4 | 28.1 |
| B4-2 | 82.5 | 93.0 | 94.9 | 93.0 | 84.4 | 95.9 | 87.3 | 94.0 | 93.0 | 87.3 | 88.2 | 93.5 |
| B4-3 | 28.9 | 32.6 | 33.2 | 32.5 | 29.5 | 33.6 | 30.5 | 32.9 | 32.6 | 30.5 | 30.9 | 32.7 |
| B5-1 | 26.9 | 30.3 | 30.9 | 30.3 | 27.5 | 31.2 | 28.4 | 30.6 | 30.3 | 28.4 | 28.7 | 30.5 |
| B5-2 | 46.3 | 52.3 | 53.4 | 52.3 | 47.4 | 53.9 | 49.0 | 52.8 | 52.3 | 49.0 | 49.6 | 52.6 |
| B5-3 | 52.4 | 59.1 | 60.3 | 59.1 | 53.6 | 60.9 | 55.4 | 59.7 | 59.1 | 55.4 | 56.1 | 59.4 |
| B5-4 | 57.8 | 65.2 | 66.5 | 65.2 | 59.1 | 67.2 | 61.1 | 65.8 | 65.1 | 61.1 | 61.8 | 65.5 |
| B5-5 | 67.1 | 75.8 | 77.3 | 75.8 | 68.7 | 78.1 | 71.1 | 76.5 | 75.8 | 71.1 | 71.9 | 76.2 |
| B5-6 | 65.8 | 74.2 | 75.8 | 74.2 | 67.3 | 76.5 | 69.7 | 75.0 | 74.2 | 69.7 | 70.4 | 74.6 |
| B5-7 | 55.1 | 62.1 | 63.4 | 62.1 | 56.3 | 64.0 | 58.3 | 62.8 | 62.1 | 58.3 | 58.9 | 62.4 |
| B5-8 | 34.2 | 38.7 | 39.4 | 38.6 | 35.1 | 39.8 | 36.2 | 39.0 | 38.6 | 36.2 | 36.6 | 38.8 |
| B6-1 | 35.7 | 40.3 | 41.1 | 40.3 | 36.5 | 41.5 | 37.8 | 40.7 | 40.3 | 37.8 | 38.2 | 40.5 |
| B6-2 | 53.5 | 60.4 | 61.7 | 60.4 | 54.8 | 62.3 | 56.7 | 61.0 | 60.4 | 56.7 | 57.3 | 60.7 |
| B6-3 | 61.4 | 69.3 | 70.7 | 69.3 | 62.8 | 71.4 | 65.0 | 70.0 | 69.3 | 65.0 | 65.7 | 69.6 |
| B6-4 | 63.6 | 71.7 | 73.2 | 71.7 | 65.0 | 73.9 | 67.3 | 72.4 | 71.7 | 67.3 | 68.0 | 72.0 |
| B6-5 | 71.4 | 80.6 | 82.2 | 80.5 | 73.1 | 83.1 | 75.5 | 81.4 | 80.6 | 75.6 | 76.4 | 81.0 |
| B6-6 | 70.0 | 79.0 | 80.6 | 79.0 | 71.6 | 81.4 | 74.0 | 79.7 | 78.9 | 74.0 | 74.9 | 79.4 |
| B6-7 | 62.1 | 70.1 | 71.5 | 70.1 | 63.6 | 72.2 | 65.7 | 70.8 | 70.1 | 65.7 | 66.5 | 70.4 |
| B6-8 | 31.1 | 35.1 | 35.8 | 35.1 | 31.8 | 36.1 | 32.9 | 35.4 | 35.1 | 32.9 | 33.3 | 35.2 |

TABLE 22-continued

| | Anti-marring index Evaluated Formulation No. by Addition of various particles | | | | | | | | | | | |
|---|---|---|---|---|---|---|---|---|---|---|---|---|
| Particle No. | 14 | 15 | 16 | 17 | 18 | 19 | 20 | 21 | 22 | 23 | 24 | 25 |
| B7-1 | 21.7 | 24.5 | 24.9 | 24.4 | 22.2 | 25.2 | 22.9 | 24.7 | 24.5 | 22.9 | 23.2 | 24.6 |
| B7-2 | 72.3 | 81.5 | 83.2 | 81.5 | 73.9 | 84.0 | 76.5 | 82.3 | 81.5 | 76.5 | 77.3 | 81.9 |
| B7-3 | 25.3 | 28.5 | 29.1 | 28.5 | 25.9 | 29.4 | 26.8 | 28.8 | 28.5 | 26.7 | 27.1 | 28.7 |
| B8-1 | 23.2 | 26.2 | 26.7 | 26.2 | 23.8 | 27.0 | 24.6 | 26.5 | 26.2 | 24.5 | 24.8 | 26.3 |
| B8-2 | 77.4 | 87.3 | 89.1 | 87.3 | 79.2 | 90.0 | 81.9 | 88.2 | 87.3 | 81.9 | 82.8 | 87.7 |
| B8-3 | 27.1 | 30.6 | 31.2 | 30.5 | 27.7 | 31.5 | 28.6 | 30.8 | 30.5 | 28.6 | 28.9 | 30.7 |
| B9-1 | 18.4 | 20.7 | 21.1 | 20.7 | 18.8 | 21.3 | 19.4 | 20.9 | 20.7 | 19.4 | 19.6 | 20.8 |
| B9-2 | 61.2 | 69.0 | 70.4 | 69.1 | 62.6 | 71.2 | 64.8 | 69.8 | 69.0 | 64.8 | 65.5 | 69.4 |
| B9-3 | 21.4 | 24.1 | 24.7 | 24.1 | 21.9 | 24.9 | 22.7 | 24.4 | 24.2 | 22.6 | 22.9 | 24.3 |
| B10-1 | 25.5 | 28.7 | 29.4 | 28.7 | 26.1 | 29.7 | 27.0 | 29.1 | 28.8 | 27.0 | 27.3 | 28.9 |
| B10-2 | 85.0 | 95.9 | 97.9 | 95.9 | 87.0 | 98.9 | 90.0 | 96.9 | 95.9 | 90.0 | 91.0 | 96.4 |
| B10-3 | 29.7 | 33.6 | 34.3 | 33.6 | 30.4 | 34.6 | 31.5 | 33.9 | 33.6 | 31.5 | 31.8 | 33.7 |

TABLE 23

| | Anti-marring index Evaluated Formulation No. by Addition of various particles | | | | | | | | | | | |
|---|---|---|---|---|---|---|---|---|---|---|---|---|
| Particle No. | 26 | 27 | 28 | 29 | 30 | 31 | 32 | 33 | 34 | 35 | 36 | 37 |
| B1-1 | 24.2 | 26.3 | 25.8 | 23.4 | 26.6 | 24.2 | 26.0 | 25.8 | 24.2 | 24.5 | 25.9 | 24.7 |
| B1-2 | 80.9 | 87.9 | 86.1 | 78.1 | 88.7 | 80.8 | 87.0 | 86.1 | 80.8 | 81.7 | 86.5 | 82.5 |
| B1-3 | 28.3 | 30.7 | 30.1 | 27.3 | 31.0 | 28.2 | 30.4 | 30.1 | 28.3 | 28.5 | 30.3 | 28.9 |
| B2-1 | 24.9 | 27.1 | 26.6 | 24.1 | 27.4 | 24.9 | 26.8 | 26.5 | 24.9 | 25.1 | 26.7 | 25.4 |
| B2-2 | 83.2 | 90.4 | 88.5 | 80.3 | 91.3 | 83.0 | 89.4 | 88.5 | 83.0 | 84.0 | 89.0 | 84.9 |
| B2-3 | 29.1 | 31.6 | 31.0 | 28.1 | 31.9 | 29.0 | 31.3 | 31.0 | 29.1 | 29.4 | 31.2 | 29.7 |
| B3-1 | 23.7 | 25.8 | 25.2 | 22.9 | 26.0 | 23.7 | 25.5 | 25.2 | 23.7 | 23.9 | 25.4 | 24.2 |
| B3-2 | 79.1 | 85.8 | 84.1 | 76.3 | 86.7 | 78.9 | 85.0 | 84.1 | 78.9 | 79.8 | 84.6 | 80.7 |
| B3-3 | 27.6 | 30.1 | 29.4 | 26.7 | 30.3 | 27.6 | 29.7 | 29.4 | 27.6 | 27.9 | 29.6 | 28.2 |
| B4-1 | 26.7 | 29.0 | 28.4 | 25.8 | 29.3 | 26.7 | 28.8 | 28.5 | 26.7 | 27.0 | 28.6 | 27.3 |
| B4-2 | 89.2 | 96.8 | 94.9 | 86.1 | 97.8 | 89.0 | 95.9 | 94.9 | 89.0 | 90.0 | 95.4 | 91.0 |
| B4-3 | 31.2 | 33.9 | 33.2 | 30.1 | 34.2 | 31.1 | 33.6 | 33.2 | 31.1 | 31.5 | 33.4 | 31.8 |
| B5-1 | 29.0 | 31.5 | 30.9 | 28.0 | 31.9 | 29.0 | 31.2 | 30.9 | 29.0 | 29.3 | 31.1 | 29.6 |
| B5-2 | 50.1 | 54.4 | 53.3 | 48.4 | 55.0 | 50.0 | 53.8 | 53.3 | 50.0 | 50.5 | 53.6 | 51.1 |
| B5-3 | 56.6 | 61.5 | 60.3 | 54.1 | 62.2 | 56.5 | 60.9 | 60.3 | 56.5 | 57.2 | 60.6 | 57.8 |
| B5-4 | 62.4 | 67.8 | 66.5 | 60.3 | 68.5 | 62.4 | 67.1 | 66.4 | 62.4 | 63.0 | 66.8 | 63.7 |
| B5-5 | 72.6 | 78.9 | 77.3 | 70.1 | 79.7 | 72.5 | 78.1 | 77.3 | 72.5 | 73.3 | 77.7 | 74.1 |
| B5-6 | 71.2 | 77.3 | 75.7 | 68.7 | 78.1 | 71.1 | 76.5 | 75.7 | 71.1 | 71.8 | 76.1 | 72.6 |
| B5-7 | 59.5 | 64.7 | 63.4 | 57.5 | 65.3 | 59.5 | 64.0 | 63.3 | 59.4 | 60.1 | 63.7 | 60.7 |
| B5-8 | 37.0 | 40.2 | 39.4 | 35.8 | 40.6 | 37.0 | 39.8 | 39.4 | 37.0 | 37.4 | 39.6 | 37.8 |
| B6-1 | 38.6 | 41.9 | 41.1 | 37.3 | 42.4 | 38.5 | 41.5 | 41.1 | 38.5 | 39.0 | 41.3 | 39.4 |
| B6-2 | 57.9 | 62.9 | 61.6 | 55.9 | 63.5 | 57.8 | 62.2 | 61.6 | 57.8 | 58.4 | 62.0 | 59.1 |
| B6-3 | 66.4 | 72.1 | 70.7 | 64.1 | 72.8 | 66.3 | 71.4 | 70.7 | 66.3 | 67.0 | 71.0 | 67.8 |
| B6-4 | 68.7 | 74.7 | 73.1 | 66.3 | 75.4 | 68.6 | 73.9 | 73.1 | 68.6 | 69.3 | 73.5 | 70.1 |
| B6-5 | 77.3 | 83.9 | 82.2 | 74.5 | 84.7 | 77.1 | 83.0 | 82.2 | 77.1 | 77.9 | 82.6 | 78.8 |
| B6-6 | 75.7 | 82.2 | 80.5 | 73.1 | 83.0 | 75.5 | 81.3 | 80.5 | 75.5 | 76.4 | 81.0 | 77.2 |
| B6-7 | 67.2 | 73.0 | 71.5 | 64.9 | 73.7 | 67.1 | 72.2 | 71.5 | 67.1 | 67.8 | 71.9 | 68.5 |
| B6-8 | 33.6 | 36.5 | 35.8 | 32.5 | 36.9 | 33.5 | 36.1 | 35.8 | 33.6 | 33.9 | 35.9 | 34.3 |
| B7-1 | 23.4 | 25.4 | 24.9 | 22.6 | 25.7 | 23.4 | 25.2 | 24.9 | 23.4 | 23.6 | 25.1 | 23.9 |
| B7-2 | 78.1 | 84.9 | 83.1 | 75.4 | 85.7 | 78.0 | 84.0 | 83.2 | 78.0 | 78.9 | 83.6 | 79.7 |
| B7-3 | 27.3 | 29.7 | 29.1 | 26.4 | 30.0 | 27.3 | 29.4 | 29.1 | 27.3 | 27.6 | 29.2 | 27.9 |
| B8-1 | 25.1 | 27.2 | 26.7 | 24.2 | 27.5 | 25.1 | 27.0 | 26.7 | 25.0 | 25.3 | 26.8 | 25.6 |
| B8-2 | 83.7 | 90.8 | 89.0 | 80.8 | 91.8 | 83.5 | 89.9 | 89.0 | 83.5 | 84.4 | 89.5 | 85.3 |
| B8-3 | 29.3 | 31.8 | 31.2 | 28.3 | 32.1 | 29.2 | 31.5 | 31.2 | 29.2 | 29.5 | 31.3 | 29.9 |
| B9-1 | 19.8 | 21.6 | 21.1 | 19.1 | 21.8 | 19.8 | 21.3 | 21.1 | 19.8 | 20.0 | 21.2 | 20.2 |
| B9-2 | 66.2 | 71.9 | 70.4 | 63.9 | 72.6 | 66.1 | 71.2 | 70.4 | 66.1 | 66.8 | 70.8 | 67.5 |
| B9-3 | 23.1 | 25.2 | 24.6 | 22.3 | 25.4 | 23.1 | 24.9 | 24.7 | 23.1 | 23.4 | 24.8 | 23.6 |
| B10-1 | 27.5 | 29.9 | 29.3 | 26.6 | 30.3 | 27.5 | 29.6 | 29.3 | 27.5 | 27.8 | 29.5 | 28.1 |
| B10-2 | 91.9 | 99.9 | 97.8 | 88.7 | 99.9 | 91.8 | 98.8 | 97.8 | 91.8 | 92.8 | 98.3 | 93.8 |
| B10-3 | 32.2 | 34.9 | 34.2 | 31.1 | 35.3 | 32.1 | 34.6 | 34.2 | 32.1 | 32.5 | 34.4 | 32.8 |

TABLE 24

| | Anti-marring index Evaluated Formulation No. by Addition of various particles | | | | | | | | | | | | |
|---|---|---|---|---|---|---|---|---|---|---|---|---|---|
| Particle No. | 1 | 2 | 3 | 4 | 5 | 6 | 7 | 8 | 9 | 10 | 11 | 12 | 13 |
| B11-1 | 16.9 | 17.5 | 17.2 | 16.3 | 17.1 | 17.3 | 16.0 | 16.7 | 17.6 | 15.6 | 13.4 | 18.0 | 18.4 |
| B11-2 | 56.4 | 58.4 | 57.4 | 54.2 | 57.0 | 57.6 | 53.3 | 55.8 | 58.8 | 52.1 | 44.8 | 60.1 | 61.3 |
| B11-3 | 19.7 | 20.4 | 20.1 | 19.0 | 20.0 | 20.2 | 18.7 | 19.5 | 20.6 | 18.2 | 15.6 | 21.0 | 21.5 |
| B12-1 | 18.0 | 18.6 | 18.3 | 17.3 | 18.2 | 18.4 | 17.0 | 17.8 | 18.8 | 16.6 | 14.3 | 19.2 | 19.6 |
| B12-2 | 60.0 | 62.1 | 61.1 | 57.8 | 60.7 | 61.4 | 56.8 | 59.4 | 62.6 | 55.5 | 47.6 | 63.9 | 65.3 |
| B12-3 | 21.0 | 21.7 | 21.4 | 20.2 | 21.2 | 21.5 | 19.9 | 20.7 | 21.9 | 19.4 | 16.6 | 22.4 | 22.8 |
| B13-1 | 15.5 | 16.1 | 15.8 | 14.9 | 15.7 | 15.9 | 14.7 | 15.4 | 16.2 | 14.3 | 12.3 | 16.6 | 16.9 |
| B13-2 | 51.8 | 53.7 | 52.8 | 49.8 | 52.4 | 52.9 | 49.0 | 51.3 | 54.1 | 47.9 | 41.1 | 55.2 | 56.4 |
| B13-3 | 18.1 | 18.8 | 18.4 | 17.5 | 18.3 | 18.5 | 17.2 | 17.9 | 18.9 | 16.8 | 14.4 | 19.3 | 19.7 |
| B14-1 | 15.0 | 15.5 | 15.3 | 14.4 | 15.2 | 15.3 | 14.2 | 14.8 | 15.7 | 13.8 | 11.9 | 16.0 | 16.3 |
| B14-2 | 50.0 | 51.8 | 50.9 | 48.1 | 50.6 | 51.1 | 47.3 | 49.5 | 52.2 | 46.2 | 39.7 | 53.3 | 54.4 |
| B14-3 | 17.5 | 18.1 | 17.8 | 16.8 | 17.7 | 17.9 | 16.5 | 17.3 | 18.3 | 16.2 | 13.9 | 18.6 | 19.0 |
| B15-1 | 26.2 | 27.1 | 26.6 | 25.2 | 26.4 | 26.7 | 24.7 | 25.9 | 27.3 | 24.2 | 20.8 | 27.9 | 28.5 |
| B15-2 | 87.3 | 90.4 | 88.9 | 84.0 | 88.3 | 89.2 | 82.6 | 86.4 | 91.1 | 80.7 | 69.3 | 93.0 | 94.9 |
| B15-3 | 30.5 | 31.6 | 31.1 | 29.4 | 30.9 | 31.2 | 28.9 | 30.2 | 31.9 | 28.2 | 24.2 | 32.6 | 33.2 |
| R1 | 39.1 | 40.4 | 39.8 | 37.6 | 39.5 | 39.9 | 37.0 | 38.7 | 40.8 | 36.1 | 31.0 | 41.6 | 42.5 |
| R2 | 41.1 | 42.6 | 41.9 | 39.6 | 41.6 | 42.0 | 38.9 | 40.7 | 42.9 | 38.0 | 32.6 | 43.8 | 44.8 |
| R3 | 13.2 | 13.7 | 13.4 | 12.7 | 13.4 | 13.5 | 12.5 | 13.1 | 13.8 | 12.2 | 10.5 | 14.1 | 14.4 |
| R4 | 44.1 | 45.6 | 44.9 | 42.4 | 44.6 | 45.1 | 41.7 | 43.6 | 46.0 | 40.8 | 35.0 | 47.0 | 48.0 |
| R5 | 35.9 | 37.1 | 36.6 | 34.5 | 36.3 | 36.7 | 34.0 | 35.5 | 37.5 | 33.2 | 28.5 | 38.3 | 39.1 |
| R6 | 38.2 | 39.5 | 38.8 | 36.8 | 38.6 | 39.0 | 36.1 | 37.8 | 39.9 | 35.3 | 30.3 | 40.7 | 41.5 |
| R7 | 38.7 | 40.0 | 39.3 | 37.2 | 39.1 | 39.5 | 36.5 | 38.2 | 40.3 | 35.7 | 30.7 | 41.2 | 42.0 |
| R8 | 41.4 | 42.8 | 42.1 | 39.8 | 41.8 | 42.3 | 39.1 | 40.9 | 43.2 | 38.2 | 32.8 | 44.1 | 45.0 |
| R9 | 32.7 | 33.9 | 33.3 | 31.5 | 33.1 | 33.4 | 30.9 | 32.4 | 34.1 | 30.2 | 26.0 | 34.9 | 35.6 |
| R10 | 45.5 | 47.1 | 46.3 | 43.8 | 46.0 | 46.5 | 43.0 | 45.0 | 47.4 | 42.0 | 36.1 | 48.4 | 49.5 |
| R11 | 28.2 | 29.1 | 28.6 | 27.1 | 28.5 | 28.8 | 26.7 | 27.9 | 29.4 | 26.0 | 22.4 | 30.0 | 30.7 |
| R12 | 30.0 | 31.0 | 30.5 | 28.9 | 30.3 | 30.7 | 28.4 | 29.7 | 31.3 | 27.7 | 23.8 | 32.0 | 32.6 |
| R13 | 25.9 | 26.8 | 26.3 | 24.9 | 26.2 | 26.5 | 24.5 | 25.6 | 27.0 | 23.9 | 20.5 | 27.6 | 28.2 |
| R14 | 25.0 | 25.9 | 25.4 | 24.1 | 25.3 | 25.5 | 23.6 | 24.7 | 26.1 | 23.1 | 19.8 | 26.6 | 27.2 |
| R15 | 43.6 | 45.2 | 44.4 | 42.0 | 44.1 | 44.6 | 41.3 | 43.2 | 45.6 | 40.3 | 34.6 | 46.5 | 47.5 |
| R16 | 27.5 | 28.4 | 27.9 | 26.4 | 27.8 | 28.1 | 26.0 | 27.2 | 28.7 | 25.4 | 21.8 | 29.2 | 29.9 |
| R17 | 28.0 | 28.9 | 28.5 | 26.9 | 28.3 | 28.6 | 26.4 | 27.7 | 29.2 | 25.9 | 22.2 | 29.8 | 30.4 |
| R18 | 26.9 | 27.9 | 27.4 | 25.9 | 27.3 | 27.5 | 25.5 | 26.7 | 28.1 | 24.9 | 21.4 | 28.7 | 29.3 |

TABLE 25

| | Anti-marring index Evaluated Formulation No. by Addition of various particles | | | | | | | | | | | |
|---|---|---|---|---|---|---|---|---|---|---|---|---|
| Particle No. | 14 | 15 | 16 | 17 | 18 | 19 | 20 | 21 | 22 | 23 | 24 | 25 |
| B11-1 | 15.8 | 17.8 | 18.2 | 17.8 | 16.1 | 18.4 | 16.7 | 18.0 | 17.8 | 16.7 | 16.9 | 17.9 |
| B11-2 | 52.7 | 59.5 | 60.7 | 59.4 | 54.0 | 61.3 | 55.8 | 60.1 | 59.5 | 55.8 | 56.4 | 59.8 |
| B11-3 | 18.4 | 20.8 | 21.2 | 20.8 | 18.9 | 21.4 | 19.5 | 21.0 | 20.8 | 19.5 | 19.7 | 20.9 |
| B12-1 | 16.8 | 19.0 | 19.4 | 19.0 | 17.2 | 19.6 | 17.8 | 19.2 | 19.0 | 17.8 | 18.0 | 19.1 |
| B12-2 | 56.1 | 63.3 | 64.6 | 63.3 | 57.4 | 65.2 | 59.4 | 63.9 | 63.3 | 59.4 | 60.0 | 63.6 |
| B12-3 | 19.6 | 22.1 | 22.6 | 22.1 | 20.1 | 22.8 | 20.7 | 22.4 | 22.1 | 20.8 | 21.0 | 22.2 |
| B13-1 | 14.5 | 16.4 | 16.7 | 16.4 | 14.9 | 16.9 | 15.4 | 16.6 | 16.4 | 15.4 | 15.6 | 16.5 |
| B13-2 | 48.4 | 54.6 | 55.8 | 54.6 | 49.6 | 56.4 | 51.3 | 55.2 | 54.7 | 51.3 | 51.8 | 54.9 |
| B13-3 | 16.9 | 19.1 | 19.5 | 19.1 | 17.4 | 19.7 | 17.9 | 19.3 | 19.1 | 17.9 | 18.1 | 19.2 |
| B14-1 | 14.0 | 15.8 | 16.1 | 15.8 | 14.3 | 16.3 | 14.8 | 15.9 | 15.8 | 14.8 | 15.0 | 15.9 |
| B14-2 | 46.8 | 52.7 | 53.8 | 52.8 | 47.8 | 54.4 | 49.5 | 53.3 | 52.8 | 49.5 | 50.0 | 53.0 |
| B14-3 | 16.3 | 18.5 | 18.8 | 18.5 | 16.7 | 19.0 | 17.3 | 18.6 | 18.5 | 17.3 | 17.5 | 18.5 |
| B15-1 | 24.5 | 27.6 | 28.2 | 27.6 | 25.1 | 28.5 | 25.9 | 27.9 | 27.6 | 25.9 | 26.2 | 27.7 |
| B15-2 | 81.6 | 92.1 | 93.9 | 92.1 | 83.5 | 94.9 | 86.4 | 93.0 | 92.1 | 86.4 | 87.3 | 92.5 |
| B15-3 | 28.5 | 32.2 | 32.9 | 32.2 | 29.2 | 33.2 | 30.2 | 32.5 | 32.2 | 30.2 | 30.5 | 32.4 |
| R1 | 36.6 | 41.3 | 42.1 | 41.2 | 37.4 | 42.5 | 38.7 | 41.7 | 41.2 | 38.7 | 39.1 | 41.5 |
| R2 | 38.5 | 43.4 | 44.3 | 43.4 | 39.3 | 44.7 | 40.7 | 43.8 | 43.4 | 40.7 | 41.2 | 43.6 |
| R3 | 12.4 | 13.9 | 14.2 | 13.9 | 12.6 | 14.3 | 13.1 | 14.1 | 14.0 | 13.1 | 13.2 | 14.0 |
| R4 | 41.2 | 46.5 | 47.5 | 46.5 | 42.2 | 47.9 | 43.6 | 47.0 | 46.5 | 43.6 | 44.1 | 46.7 |
| R5 | 33.6 | 37.9 | 38.7 | 37.9 | 34.3 | 39.1 | 35.5 | 38.2 | 37.9 | 35.5 | 35.9 | 38.0 |
| R6 | 35.7 | 40.3 | 41.1 | 40.3 | 36.5 | 41.5 | 37.8 | 40.7 | 40.3 | 37.8 | 38.2 | 40.5 |
| R7 | 36.1 | 40.7 | 41.6 | 40.8 | 37.0 | 42.0 | 38.2 | 41.2 | 40.7 | 38.2 | 38.6 | 40.9 |
| R8 | 38.7 | 43.6 | 44.5 | 43.6 | 39.6 | 45.0 | 40.9 | 44.1 | 43.6 | 40.9 | 41.4 | 43.8 |
| R9 | 30.6 | 34.5 | 35.2 | 34.5 | 31.3 | 35.6 | 32.4 | 34.9 | 34.5 | 32.4 | 32.7 | 34.7 |
| R10 | 42.5 | 47.9 | 48.9 | 47.9 | 43.5 | 49.5 | 45.0 | 48.4 | 47.9 | 45.0 | 45.5 | 48.2 |

TABLE 25-continued

| | Anti-marring index Evaluated Formulation No. by Addition of various particles | | | | | | | | | | | |
|---|---|---|---|---|---|---|---|---|---|---|---|---|
| Particle No. | 14 | 15 | 16 | 17 | 18 | 19 | 20 | 21 | 22 | 23 | 24 | 25 |
| R11 | 26.3 | 29.7 | 30.3 | 29.7 | 27.0 | 30.7 | 27.9 | 30.0 | 29.7 | 27.9 | 28.2 | 29.9 |
| R12 | 28.0 | 31.6 | 32.3 | 31.6 | 28.7 | 32.6 | 29.7 | 32.0 | 31.6 | 29.7 | 30.0 | 31.8 |
| R13 | 24.2 | 27.3 | 27.9 | 27.3 | 24.8 | 28.2 | 25.6 | 27.6 | 27.3 | 25.6 | 25.9 | 27.4 |
| R14 | 23.4 | 26.4 | 26.9 | 26.4 | 23.9 | 27.2 | 24.7 | 26.6 | 26.4 | 24.7 | 25.0 | 26.5 |
| R15 | 40.8 | 46.0 | 47.0 | 46.0 | 41.8 | 47.5 | 43.2 | 46.5 | 46.0 | 43.2 | 43.6 | 46.3 |
| R16 | 25.6 | 29.0 | 29.6 | 28.9 | 26.3 | 29.8 | 27.1 | 29.3 | 28.9 | 27.2 | 27.4 | 29.1 |
| R17 | 26.2 | 29.5 | 30.1 | 29.5 | 26.7 | 30.4 | 27.7 | 29.8 | 29.5 | 27.7 | 28.0 | 29.7 |
| R18 | 25.2 | 28.4 | 29.0 | 28.4 | 25.8 | 29.3 | 26.7 | 28.7 | 28.4 | 26.7 | 26.9 | 28.6 |

15

TABLE 26

| | Anti-marring index Evaluated Formulation No. by Addition of various particles | | | | | | | | | | | |
|---|---|---|---|---|---|---|---|---|---|---|---|---|
| Particle No. | 26 | 27 | 28 | 29 | 30 | 31 | 32 | 33 | 34 | 35 | 36 | 37 |
| B11-1 | 17.1 | 18.5 | 18.2 | 16.5 | 18.7 | 17.1 | 18.3 | 18.2 | 17.0 | 17.2 | 18.3 | 17.4 |
| B11-2 | 57.0 | 61.9 | 60.6 | 55.0 | 62.5 | 56.9 | 61.3 | 60.6 | 56.9 | 57.5 | 61.0 | 58.2 |
| B11-3 | 19.9 | 21.7 | 21.2 | 19.2 | 21.9 | 19.9 | 21.4 | 21.2 | 19.9 | 20.1 | 21.3 | 20.3 |
| B12-1 | 18.2 | 19.8 | 19.4 | 17.5 | 20.0 | 18.1 | 19.5 | 19.3 | 18.2 | 18.4 | 19.4 | 18.5 |
| B12-2 | 60.7 | 65.9 | 64.6 | 58.6 | 66.5 | 60.6 | 65.2 | 64.5 | 60.5 | 61.2 | 64.9 | 61.9 |
| B12-3 | 21.2 | 23.1 | 22.6 | 20.5 | 23.3 | 21.2 | 22.8 | 22.6 | 21.2 | 21.4 | 22.7 | 21.7 |
| B13-1 | 15.7 | 17.1 | 16.7 | 15.1 | 17.2 | 15.7 | 16.9 | 16.7 | 15.7 | 15.9 | 16.8 | 16.0 |
| B13-2 | 52.4 | 56.9 | 55.7 | 50.6 | 57.5 | 52.3 | 56.3 | 55.8 | 52.3 | 52.9 | 56.0 | 53.4 |
| B13-3 | 18.3 | 19.9 | 19.5 | 17.7 | 20.1 | 18.3 | 19.7 | 19.5 | 18.3 | 18.5 | 19.6 | 18.7 |
| B14-1 | 15.1 | 16.5 | 16.1 | 14.6 | 16.6 | 15.1 | 16.3 | 16.1 | 15.1 | 15.3 | 16.2 | 15.4 |
| B14-2 | 50.5 | 54.9 | 53.8 | 48.8 | 55.4 | 50.5 | 54.3 | 53.8 | 50.5 | 51.0 | 54.1 | 51.6 |
| B14-3 | 17.7 | 19.2 | 18.8 | 17.1 | 19.4 | 17.6 | 19.0 | 18.8 | 17.7 | 17.8 | 18.9 | 18.0 |
| B15-1 | 26.4 | 28.7 | 28.1 | 25.6 | 29.1 | 26.4 | 28.4 | 28.2 | 26.4 | 26.7 | 28.3 | 27.0 |
| B15-2 | 88.3 | 95.8 | 93.9 | 85.2 | 96.8 | 88.1 | 94.9 | 93.9 | 88.1 | 89.1 | 94.4 | 90.0 |
| B15-3 | 30.9 | 33.5 | 32.9 | 29.8 | 33.9 | 30.8 | 33.2 | 32.9 | 30.8 | 31.1 | 33.0 | 31.5 |
| R1 | 39.5 | 42.9 | 42.1 | 38.2 | 43.4 | 39.5 | 42.5 | 42.1 | 39.5 | 39.9 | 42.3 | 40.3 |
| R2 | 41.6 | 45.2 | 44.3 | 40.1 | 45.6 | 41.5 | 44.7 | 44.2 | 41.5 | 42.0 | 44.5 | 42.4 |
| R3 | 13.3 | 14.5 | 14.2 | 12.9 | 14.6 | 13.3 | 14.4 | 14.2 | 13.3 | 13.5 | 14.3 | 13.6 |
| R4 | 44.6 | 48.4 | 47.4 | 43.0 | 48.9 | 44.5 | 47.9 | 47.4 | 44.5 | 45.0 | 47.7 | 45.5 |
| R5 | 36.3 | 39.4 | 38.6 | 35.0 | 39.8 | 36.2 | 39.0 | 38.6 | 36.2 | 36.6 | 38.8 | 37.0 |
| R6 | 38.6 | 41.9 | 41.1 | 37.3 | 42.4 | 38.5 | 41.5 | 41.1 | 38.5 | 38.9 | 41.3 | 39.4 |
| R7 | 39.1 | 42.4 | 41.6 | 37.7 | 42.9 | 39.0 | 42.0 | 41.5 | 39.0 | 39.4 | 41.8 | 39.8 |
| R8 | 41.8 | 45.4 | 44.5 | 40.3 | 45.9 | 41.7 | 45.0 | 44.5 | 41.7 | 42.2 | 44.7 | 42.6 |
| R9 | 33.1 | 36.0 | 35.2 | 31.9 | 36.3 | 33.0 | 35.6 | 35.2 | 33.0 | 33.4 | 35.4 | 33.7 |
| R10 | 46.0 | 49.9 | 48.9 | 44.4 | 50.4 | 45.9 | 49.4 | 48.9 | 45.9 | 46.4 | 49.1 | 46.9 |
| R11 | 28.5 | 31.0 | 30.3 | 27.5 | 31.3 | 28.4 | 30.6 | 30.3 | 28.4 | 28.7 | 30.5 | 29.1 |
| R12 | 30.3 | 32.9 | 32.2 | 29.3 | 33.2 | 30.2 | 32.6 | 32.2 | 30.3 | 30.6 | 32.4 | 30.9 |
| R13 | 26.2 | 28.4 | 27.8 | 25.3 | 28.7 | 26.1 | 28.1 | 27.8 | 26.2 | 26.4 | 28.0 | 26.7 |
| R14 | 25.3 | 27.4 | 26.9 | 24.4 | 27.7 | 25.2 | 27.1 | 26.9 | 25.2 | 25.5 | 27.0 | 25.8 |
| R15 | 44.1 | 47.9 | 46.9 | 42.6 | 48.4 | 44.0 | 47.4 | 47.0 | 44.0 | 44.5 | 47.2 | 45.0 |
| R16 | 27.8 | 30.2 | 29.5 | 26.8 | 30.4 | 27.7 | 29.8 | 29.5 | 27.7 | 28.0 | 29.7 | 28.3 |
| R17 | 28.3 | 30.7 | 30.1 | 27.3 | 31.0 | 28.2 | 30.4 | 30.1 | 28.2 | 28.5 | 30.3 | 28.8 |
| R18 | 27.2 | 29.6 | 29.0 | 26.3 | 29.9 | 27.2 | 29.3 | 29.0 | 27.2 | 27.5 | 29.1 | 27.8 |

Example 3

Detergent compositions specified in Table 28 were prepared by the use of various kinds of globular particles listed in Table 27 according to the following formulation.

The obtained compositions were examined for anti-marring index in the same manner as that employed in Example 1, and the results together with the viscosities thereof at 20° C. are given in Table 28.

Formulation of Detergent Composition

| | |
|---|---|
| particles | 7.0% |
| dimethylsiloxane (500 cst, 25° C.) | 5.0% |
| isoparaffin (b.p.: 262° C.) | 10.0% |
| alkylglucoside ($C_{12}$–$C_{14}$) | 2.0% |
| polysodium acrylate (MW:3,000) | 0.5% |
| ion-exchanged water | the balance |

TABLE 27

| Particle No. | Shape | Material | Elastic modulus (kg/mm$^2$) | Surface energy (dyn/cm) | Mean diam. ($\mu$m) | True sp gr. | Sphericity |
|---|---|---|---|---|---|---|---|
| B16 | globular particle | high d.p. polydimethylsiloxane | 23 | 25 | 3 | 0.97 | 98 |
| B17 | globular particle | polyorganosilsesqui-oxane | 125 | 28 | 3 | 1.3 | 95 |
| B18 | globular particle | butyl acrylate/styrene (50/50) copolymer | 180 | 36 | 3 | 1.08 | 100 |
| B19 | globular particle | polystyrene | 400 | 35 | 2 | 1.05 | 100 |
| B20 | globular particle | styrene/butyl acrylate /divinylbenzene (70/20/10) copolymer | 600 | 42 | 3 | 1.15 | 100 |

TABLE 28

| | Particle No. | | | | |
|---|---|---|---|---|---|
| | B16 | B17 | B18 | B19 | B20 |
| Viscosity (cps) | 211.6 | 49.8 | 159.7 | 232.1 | 231.9 |
| Anti-marring index | 75.9 | 96.2 | 89.6 | 73.8 | 70.5 |

Example 4

Detergent compositions according to the present invention and comparative detergent compositions were prepared by the use of components listed in Table 29 according to the formulations specified in Table 29.

The obtained compositions were examined for detergency and workability by the following methods, and the results together with the viscosities thereof at 20° C. are given in Table 29.

Method for Evaluating Detergency

In the same manner as that employed in the evaluation of anti-marring performance in Example 1, the same dirt (rapeseed oil/carbon black, Seven dusts for JIS test) as that used in Example 1 was made to adhere to a white acrylic plate (10 cm×20 cm) in the same amount as that employed therein. Each detergent composition was sprayed on the resulting plate in an amount of 10 g/m$^2$. The whole surface of the resulting plate was uniformly wiped with a towel of cotton pile (2 cm×5 cm) doubled widthwise under a load of 10 g wt./m$^2$ three times. The rate of removal of dirt was evaluated with the eye and graded according to the following five ranks. This evaluation was repeated five times, and the average of the five points was calculated and taken as the detergency of the composition.

1: no dirt is removed
2: the area ratio of the surface freed from dirt to the surface still having dirt thereon is ¼ or above
3: the area ratio of the surface freed from dirt to the surface still having dirt thereon is ⅔ or above
4: the area ratio of the surface freed from dirt to the surface still having dirt thereon is ¾ or above
5: the dirt is completely removed

Method for Evaluating Workability

Each detergent composition was sprayed on a black acrylic plate (1 m×1 m) in an amount of 10 g/m$^2$. Five female panelists (height: 155 to 165 cm, weight: 45 to 50 kg) wipe the resulting plate with towels (40 cm×40 cm) of cotton pile folded into four to evaluate the workability according to the following five ranks. The average of the points given by the five panelists is taken as the workability of the composition.

1: complete removal by wiping is impossible
2: heavier than wiping with damp cloth
3: equivalent to wiping with damp cloth
4: lighter than wiping with damp cloth
5: equivalent to wiping with dry cloth

TABLE 29

| | Comp. | Invention | | | | | | | | Comp. |
|---|---|---|---|---|---|---|---|---|---|---|
| Detergent composition No. | 1 | 2 | 3 | 4 | 5 | 6 | 7 | 8 | 9 | 10 |
| Formulation (% by wt.) | | | | | | | | | | |
| globular particle*1 | 6 | 6 | 6 | 6 | 6 | 6 | 6 | 6 | 6 | 6 |
| dimethylsiloxane (100 cst, 25° C.) | 1 | 1 | 1 | 1 | 1 | 1 | 1 | 1 | 1 | 1 |
| dimethylsiloxane (1 cst, 25° C.) | 28 | 10 | 3 | 3 | 3 | 3 | 3 | 3 | 3 | 3 |
| cyclotetra(dimethylsiloxane) | 30 | 30 | 2 | 2 | 2 | 2 | 2 | 2 | 2 | 2 |
| modified silicone*2 | 0.1 | 0.1 | 0.1 | 0.1 | 0.1 | 0.1 | 0.1 | 0.1 | 0.1 | 0.1 |
| ethanol | 25 | 20 | 5 | — | — | — | — | — | — | — |
| isoparaffin (b.p.: 262° C.) | 3 | 3 | 3 | 3 | 3 | 3 | 3 | 3 | 3 | 3 |
| alkylglucoside ($C_{12}$–$C_{14}$) | 2 | 2 | 2 | 2 | 2 | 2 | 2 | 2 | 2 | 2 |
| poly(sodium acrylate) (MW:3,000) | — | — | — | 0.06 | — | 0.06 | 0.06 | 0.06 | 0.06 | 0.06 |
| xanthan gum*3 | — | — | — | — | 0.08 | 0.09 | 0.15 | 0.3 | 0.4 | 0.6 |
| ion-exchanged water | the balance | the balance | the balance | the balance | the balance | the balance | the balance | the balance | the balance | the balance |

TABLE 29-continued

| | Comp. | Invention | | | | | | | | Comp. |
|---|---|---|---|---|---|---|---|---|---|---|
| Detergent composition No. | 1 | 2 | 3 | 4 | 5 | 6 | 7 | 8 | 9 | 10 |
| Viscosity (20° C., cps) | 1.8 | 2.5 | 8.2 | 18.3 | 43.2 | 62.8 | 83.6 | 182.1 | 384.3 | 621.8 |
| Detergency | 2.6 | 3.2 | 4.5 | 4.8 | 4.7 | 4.5 | 4.3 | 3.9 | 3.1 | 2.4 |
| Workability | 1.5 | 3.1 | 4.5 | 4.8 | 4.6 | 4.3 | 4.1 | 3.2 | 3 | 1 |

notes)

*1: methylpolysiloxane network polymer, globular particles, mean diam.: 2 μm, elastic modulus: 120 kg/mm$^2$, surface energy: 30 dyn/cm, true sp. gr.: 1.3; sphericity: 95, KMP-590, a product of Shin-Etsu Chemical Co., Ltd.

*2: poly(aminopropyl-methylsiloxane/dimethylsiloxane), KF-868, a product of Shin-Etsu Chemical Co., Ltd.

*3: Kelzan, a product of KELCO Co.

What is claimed is:

1. A liquid detergent composition for cleaning hard surfaces having a particulate solid dirt thereon by applying the composition to the surface and wiping off the dirt, wherein the composition comprises:

(a) a liquid deterging medium;

(b) globular particles having a mean particle diameter of 0.01 to 15 μm and being insoluble in the liquid deterging medium selected from the group consisting of (1) a silicone resin having units represented by the formulae (I) and (I'), and (2) a polyorganosilsesquioxane prepared by hydrolyzing and condensing a methyltrialkoxysilane or a partially hydrolyzed and condensed product thereof in a aqueous solution of ammonia or aqueous solution of an amine compound:

(I)

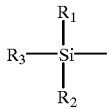

(I')

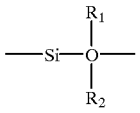

wherein $R_1$, $R_2$ and $R_3$ are each independently, a $C_1$–$C_{100}$ alkyl group, an alkoxy group, a hydroxyalkyl group, hydroxyl group, a siloxy group, a carboxyl group, a carboxyalkyl group, an N-(2-aminoalkyl) aminoalkyl group, an aminoalkyl group, an amino group, an epoxyalkyl group, an epoxy group, a methylpolyoxyethylenealkyl group, a hydroxypolyoxyethylenealkyl group, a methylpolyoxyethylene-polyoxypropylene group, a hydroxypolyoxyethylene-polyoxypropylene group, an alkylpolyoxyethylene group, a polyoxyethylene group, a phenyl group or a fluoroalkyl group; and (c) a polyorganosiloxane oil being liquid at 20° C., the content of component (b) in the composition being 0.1 to 30% by weight, said composition having a viscosity of 2 to 500 cps as determined at 20° C. in a uniformly stirred state wherein said composition is free of waxes.

2. The liquid detergent composition for cleaning hard surfaces as claimed in claim 1, which further comprises (c) at a mixing weight ratio of component (c) to component (b) of 0.01 to 10.

3. The liquid detergent composition for hard surfaces as claimed in claim 2, which further comprises (d) a surfactant, a polymeric dispersant or a mixture thereof.

4. The detergent composition as claimed in claim 1, in which the surface energy of a material constituting the globular particles is 60 dyn/cm or below.

5. The detergent composition as claimed in claim 1, in which a true specific gravity of the globular particles is in the range from 0.5 to 2.5.

6. The detergent composition as claimed claim 1, in which an elastic modulus of the globular particles is in the range from 10 to 1,000 kg/mm$^2$.

7. The detergent composition as claimed in claim 1, in which the liquid deterging medium (a) is water or a mixture of water with an organic solvent.

8. The detergent composition as claimed in claim 1, in which the hard surface is a car body.

9. A method for cleaning a hard surface, which comprises steps of applying the composition according to claim 1 to the hard surface having a particulate solid dirt thereon and wiping off the composition together with the dirt from the surface.

10. A method for cleaning a car body which comprises applying a composition comprising:

(a) a liquid deterging medium;

(b) globular particles having a mean particle diameter of 0.01 to 15 μm and being insoluble in the liquid deterging medium, selected from the group consisting of (1) a silicone resin having units represented by the formulae (I) and (I'), and (2) a polyorganosilsesquioxane prepared by hydrolyzing and condensing a methyltrialkoxysilane or a partially hydrolyzed and condensed product thereof in a aqueous solution of ammonia or aqueous solution of an amine compound:

(I)

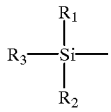

(I')

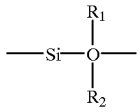

wherein $R_1$, $R_2$ and $R_3$ are each independently, a $C_1$–$C_{100}$ alkyl group, an alkoxy group, a hydroxyalkyl group, hydroxyl group, a siloxy group, a carboxyl group, a carboxyalkyl group, an N-(2-aminoalkyl) aminoalkyl group, an aminoalkyl group, an amino group, an epoxyalkyl group, an epoxy group, a methylpolyoxyethylenealkyl group, a hydroxypolyoxyethylenealkyl group, a methylpolyoxyethylene-polyoxypropylene group, a hydroxypolyoxyethylene-polyoxypropylene group, an alkylpolyoxyethylene group, a polyoxyethylene group, a phenyl group or a fluoroalkyl group; and (c) a polyorganosiloxane oil being liquid at 20° C., the content of component (b) in the composition being 0.1 to 30% by weight, the weight ratio of component (c) to the component (b) being 0.01 to 10, said composition having a viscosity of 2 to 500 cps as determined at 20° C. in a uniformly stirred state and wherein said composition is free of waxes, to the car body having a particulate solid dirt thereon and wiping off the composition together with the dirt without pre-cleaning.

11. The method as claimed in claim 9, in which the detergent composition is applied to the hard surface so that the globular particles may be present on the surface in the range from 0.05 to 5 $g/m^2$.

12. The method as claimed in claim 9, in which the detergent composition is applied to the hard surface so that the total projected area of the globular particles may account for 30 to 300% of the surface area of the hard surface.

13. The method as claimed in claim 9, in which the detergent composition is applied to the hard surface in a small amount of 50 g or below based on 1 $m^2$ of the surface.

* * * * *